US009972187B1

(12) United States Patent
Srinivasan et al.

(10) Patent No.: US 9,972,187 B1
(45) Date of Patent: May 15, 2018

(54) BIOMECHANICAL PARAMETER DETERMINATION FOR EMERGENCY ALERTING AND HEALTH ASSESSMENT

(71) Applicant: Agility4Life, Mountain View, CA (US)

(72) Inventors: Seshadri Srinivasan, Santa Clara, CA (US); Uday Kiran Chaka, Mountain View, CA (US)

(73) Assignee: Agility4Life, Mountain View, CA (US)

( * ) Notice: Subject to any disclaimer, the term of this patent is extended or adjusted under 35 U.S.C. 154(b) by 27 days.

(21) Appl. No.: 15/350,100

(22) Filed: Nov. 13, 2016

(51) Int. Cl.
*G08B 23/00* (2006.01)
*G08B 21/04* (2006.01)
*G08B 21/02* (2006.01)

(52) U.S. Cl.
CPC ..... *G08B 21/0446* (2013.01); *G08B 21/02* (2013.01); *G08B 21/0423* (2013.01); *G08B 21/0438* (2013.01); *G08B 21/0476* (2013.01)

(58) Field of Classification Search
CPC .. G08B 21/043; G08B 21/0438; G08B 21/02; G08B 21/0423; G08B 21/0476
See application file for complete search history.

(56) References Cited

U.S. PATENT DOCUMENTS

2014/0089243 A1* 3/2014 Oppenheimer ..... G06F 21/50 706/46
2014/0155705 A1* 6/2014 Papadopoulos ..... A61B 5/0022 600/301

OTHER PUBLICATIONS

Jama L. Purser et al., "Walking speed predicts health status and hospital costs for frail elderly male veterans", Jul. 2005, vol. 42, No. 4, Journal of Rehabilitation Research & Development (JRRD).

(Continued)

*Primary Examiner* — Omeed Alizada
(74) *Attorney, Agent, or Firm* — Ash Tankha; Lipton, Weinberger & Husick

(57) ABSTRACT

A method and a biomechanical parameter determination system (BPDS) for determining biomechanical parameters of one or more target objects in a region are provided. The BPDS dynamically receives first data including temperature data and/or motion data of target objects in the region from first sensors and dynamically receives second data including optical images, sound data, amplitude, and/or distance of the target objects in the region from second sensors, over a network. The BPDS filters the dynamically received first data and second data of the target objects and identifies one or more target objects using the temperature data and/or motion data of the target objects. The BPDS determines one or more biomechanical parameters including, for example, positions, acceleration, walking speed, fall, posture, etc., associated with each of the identified target objects in the region using the filtered first data and/or the filtered second data for emergency alerting and/or health assessment.

39 Claims, 19 Drawing Sheets

(56) References Cited

OTHER PUBLICATIONS

Joe Verghese et al., "Abnormality of gait as a predictor or non-Alzheimer's dementia", Nov. 28, 2002, vol. 347, No. 22, The New England Journal of Medicine, www.nejm.org.
N. Noury et al., "A proposal for the classification and evaluation of fall detectors", IRBM 29 (2008) 340-349.
A. Sixsmith et al., "Pyroelectric IR sensor arrays for fall detection in the older population", J. Phys. IV France 128 (2005) 153-160.
Xiaomu Luo et al., "Design and implementation of a distributed fall detection system based on wireless sensor networks", EURASIP Journal on Wireless Communications and Networking 2012, 2012:118.

* cited by examiner

BIOMECHANICAL PARAMETER DETERMINATION FOR EMERGENCY ALERTING AND HEALTH ASSESSMENT

BACKGROUND

An aging population faces significant healthcare challenges and for senior citizens it is a growing concern worldwide. In the United States of America, 13% of the population is over age 65, a percentage which is projected to reach 19% by 2030. More than one third of senior citizens live alone which creates significant challenges in the healthcare space. For example, a lack of visibility regarding the well-being of senior citizens and an inability to quickly respond to their needs will burden the existing healthcare system if the current trajectory continues. Falls are known to be the primary reason of injury related death for senior citizens and the second reason of injury related death for persons of all ages. Immediate treatment of falls is required to increase the life span of an elderly patient and to reduce long-term treatment costs. Falls can occur under several scenarios, for example, falls from walking or standing, falls from standing on supports such as ladders, etc., falls from sleeping or lying in a bed, falls from sitting on a chair, falls due to obstacles, etc.

Conventional wearable fall determination systems comprising, for example, accelerometers, posture sensors, global positioning system devices, mechanical and sound alarms, etc., are typically wrapped around a user's body and are required to be worn throughout the day and night, which is intrusive and inconvenient to the user. If a user chooses not to wear a fall determination system around the user's body at all times, and the user encounters a fall or any other incident when the fall determination system is not worn, the fall could lead to a severe injury or death. Moreover, the majority of the conventional wearable fall determination systems require a user to push a panic alert button, if the user needs help or has fallen. When the user pushes the panic alert button on a conventional fall determination system, the conventional fall determination system transmits a signal to a predetermined receiver over a network. The receiver then assists the user until, for example, a medical professional, a medical assistant, an emergency responder, etc., arrives at the user's location. Users who experience a severe fall may not be able to press the panic alert button after the fall and hence cannot alert a respondent. Furthermore, conventional fall determination systems do not detect falls in real time, or predict a risk of a fall.

Other conventional fall determination systems that are non-wearable eliminate a few of the drawbacks of the conventional wearable fall determination systems. However, most of the conventional non-wearable fall determination systems utilize a single sensor to detect a fall and fail to handle errors leading to erroneous alerts to caretakers. The conventional fall determination systems with a single sensor have a low signal to noise ratio and are more prone to erroneous readings resulting in generation of false warning alerts. Moreover, the conventional fall determination systems do not monitor the health status of the user and do not alert caretakers when the health status of the user declines which is an early sign of a fall.

Some conventional systems utilize thermal cameras to determine body temperature maps. However, thermal cameras are expensive and require calibration. Conventional passive infrared based motion detectors are based on detecting temperature changes in a field of view. However, these conventional passive infrared based motion detectors do not detect stationary objects and are not reliable for fall determination. Furthermore, while conventional systems detect falls by calculating data related to the falls and comparing that data to various thresholds, these conventional systems fail to differentiate a fall that could lead to an injury or death from a typical fall related to a regular activity performed by the user, for example, falling onto a couch to rest.

Hence, there is a long felt need for a method and a non-intrusive biomechanical parameter determination system operably coupled to multiple sensors of different types for identifying target objects, for example, humans, stationary objects, etc., determining biomechanical parameters, for example, a fall, posture, walking speed, positions, acceleration, etc., of one or more of the target objects, for example, elderly persons and other users in a region in real time, differentiating between different types of falls, determining the severity levels of the falls, and enhanced alerting without requiring the target objects to press a panic alert button. Furthermore, there is a need for a method and a biomechanical parameter determination system for monitoring the health status of a target object to identify symptoms or a risk of a fall in advance for advanced emergency alerting and intervention before irreversible deterioration or a fall occurs, thereby improving response time and chances of a full recovery.

SUMMARY OF THE INVENTION

This summary is provided to introduce a selection of concepts in a simplified form that are further disclosed in the detailed description of the invention. This summary is not intended to determine the scope of the claimed subject matter.

The method and the non-intrusive biomechanical parameter determination system (BPDS) operably coupled to multiple sensors of different types disclosed herein address the above mentioned need for identifying target objects, for example, humans, stationary objects, etc., and determining biomechanical parameters, for example, a fall, posture, walking speed, positions, acceleration, etc., of one or more of the target objects, for example, elderly persons and other users in a region in real time. Furthermore, the method and the BPDS disclosed herein address the above mentioned needs for differentiating between different types of falls, determining the severity levels of the falls, and enhanced alerting without requiring the target objects to press a panic alert button. Furthermore, the method and the BPDS disclosed herein address the above mentioned need for monitoring the health status of a target object to identify symptoms or a risk of a fall in advance for advanced emergency alerting and intervention before irreversible deterioration or a fall occurs, thereby improving response time and chances of a full recovery.

The method disclosed herein employs the biomechanical parameter determination system (BPDS) comprising at least one processor configured to execute computer program instructions for determining biomechanical parameters, for example, a fall, posture, walking speed, positions, acceleration, etc., of one or more target objects in a region in real time. The BPDS dynamically receives first data comprising temperature data and/or motion data of one or more target objects in the region from one or more first sensors, for example, pyroelectric infrared sensors positioned in one or more spatial directions in the region over a network. The BPDS dynamically receives second data comprising optical images, and/or sound data, and/or amplitude, and/or distance of the target objects in the region from one or more second sensors, for example, optical sensors, ultrasound sensors, audio sensors, etc., positioned in one or more spatial directions in the region over the network. The BPDS filters the dynamically received first data and the dynamically received second data of the target objects. The BPDS identifies one or more target objects in the region using the temperature data and/or the motion data of the target objects in the region extracted from the filtered first data. The BPDS determines one or more of multiple biomechanical parameters associated with each of the identified target objects in the region using the filtered first data and/or the filtered second data for emergency alerting and health assessment.

In an embodiment, the biomechanical parameter determination system (BPDS) determines the biomechanical parameters of the identified target objects in the region in real time as follows: The BPDS determines positions of the identified target objects in the region and tracks the determined positions of the identified target objects as a function of time to generate position-time values. The BPDS determines speed of motion of each of the identified target objects extracted from the filtered first data and/or the filtered second data using the generated position-time values. The BPDS determines acceleration of each of the identified target objects using the generated position-time values or the determined speed of motion of each of the identified target objects. The BPDS determines walking speed of each of the identified target objects using the determined speed of motion of each of the identified target objects based on walking criteria. The BPDS determines fall and posture of each of the identified target objects using one or more of the determined speed of motion of each of the identified target objects, the determined acceleration of each of the identified target objects, and change in the determined positions of the identified target objects followed by a predetermined time period of inactivity by each of the identified target objects, to alert a respondent.

In one or more embodiments, related systems comprise circuitry and/or programming for effecting the methods disclosed herein; the circuitry and/or programming can be any combination of hardware, software, and/or firmware configured to effect the methods disclosed herein depending upon the design choices of a system designer. Also, various structural elements can be employed depending on the design choices of the system designer.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and components disclosed herein. The description of a method step or a component referenced by a numeral in a drawing is applicable to the description of that method step or component shown by that same numeral in any subsequent drawing herein.

DETAILED DESCRIPTION OF THE INVENTION

Figure 1A:
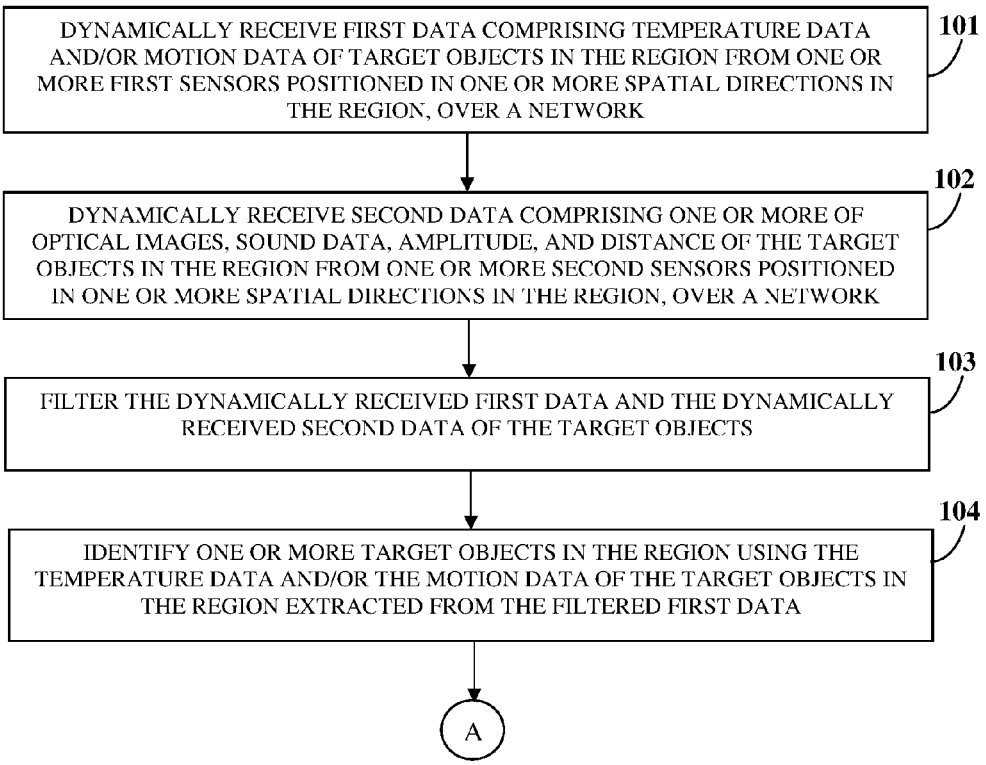
FIGS. 1A-1B illustrate a method for determining biomechanical parameters of one or more target objects in a region.
Figure 1B:
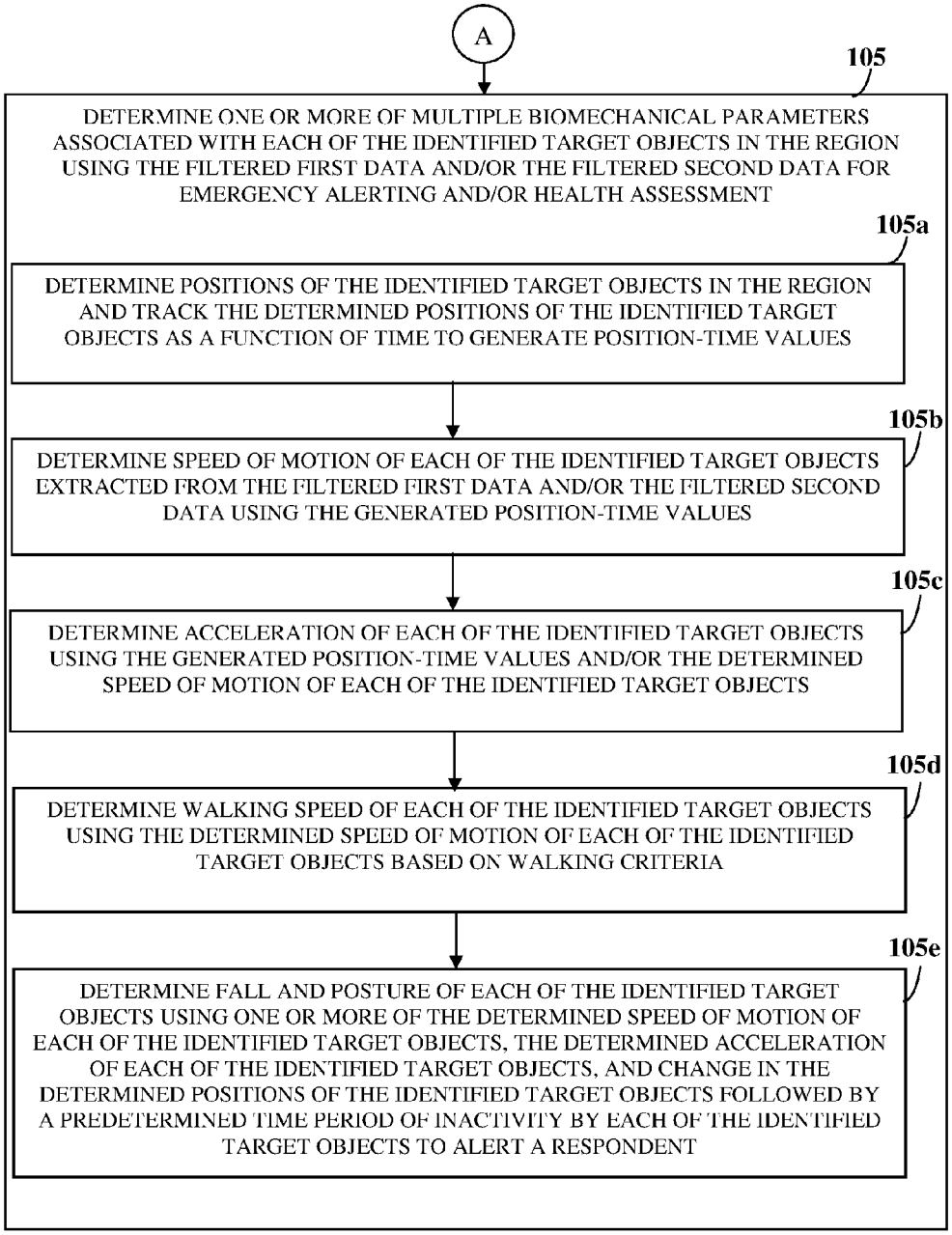

FIGS. 1A-1B illustrate a method for determining biomechanical parameters of one or more target objects in a region. As used herein, "biomechanical parameters" refer to elements related to structure, movements, and actions, for example, position, acceleration, speed of motion, fall, posture, etc., of a body part of a target object. Also, as used herein, "target objects" refers to entities, for example, humans such as elderly persons, etc., that are monitored by the biomechanical parameter determination system (BPDS) for determining their biomechanical parameters. Also, as used herein, the term "region" refers to a multidimensional space, for example, a two-dimensional space or a three-dimensional space occupied by one or more target objects and where different sensors of different types operate and communicate with the BPDS for detecting the target objects. A region is, for example, an area, a volume, or portion of a room, a living area, an outdoor area, a part of a community hall, a hospital, etc., that can be occupied by target objects. The method disclosed herein employs the BPDS comprising at least one processor configured to execute computer program instructions for determining biomechanical parameters of one or more target objects in a region. In an embodiment, the BPDS is implemented on an external computing device that is operably coupled to multiple sensors via a network, for example, a wired network or a wireless network. In another embodiment, the BPDS is implemented within each of the sensors for processing data received from the sensors and for determining biomechanical parameters of one or more target objects in a region. In another embodiment, the BPDS is implemented on a remote server that communicates with the sensors remotely via a network, for example, the internet.

The biomechanical parameter determination system (BPDS) dynamically receives 101 first data comprising, for example, temperature data and/or motion data of one or more target objects in the region from one or more first sensors, for example, one-dimensional pyroelectric or passive infrared (PIR) sensors, two-dimensional PIR sensors, etc., positioned in one or more different spatial directions in the region, over a network, for example, a wired network or a wireless network. In an embodiment, the PIR sensors are positioned in one or more arrays and used in conjunction with other devices, for example, radio frequency identification (RFID) tags, position sensing devices, motion sensors, etc., for detecting one or more target objects in the region and generating output data. The first data generated by the first sensors comprises, for example, temperature values, or voltage values, or binary values corresponding to motion, or any combination thereof. The temperature data and/or the motion data comprise, for example, samples of an area or a volume along any regular grid or irregular grid. In an embodiment, the first sensors, for example, the PIR sensors obtain the temperature data and/or the motion data without processing and transmit the temperature data and/or the motion data as raw data to the BPDS via the network for processing. In another embodiment, the first sensors transmit the temperature data and/or the motion data to a detector or an estimator within or external to the BPDS for processing. The detector or the estimator external to the BPDS then transmits the processed temperature data and/or motion data to the BPDS for further processing.

The biomechanical parameter determination system (BPDS) transforms the temperature data received from the first sensors as follows. The temperature data received from the first sensors comprise binary values, for example, 1 or 0. The binary value 1 indicates a change in temperature near the 98 degree Fahrenheit, that is, 37 degree Celsius range. The binary value 0 indicates no change in the temperature. The BPDS obtains the temperature data from all the first sensors in the region such as a room, for example, as a bit map "0000100010". In an embodiment where the first sensors are positioned physically, for example, 9 degrees apart each, from one wall to another wall in the room to complete 90 degrees at the corner of the room, the BPDS identifies whether there is a human in the room and also where the human is approximately located based on geometric calculations performed using the physical distribution of the first sensors and their field of view. For example, the temperature data with the binary value 1 indicates that a human is found at 30 degrees from the x-axis and another binary value 1 indicates that the human is found at 45 degrees from the y-axis. The BPDS therefore transforms the bit map "0000100010" to "human detected at (3 feet (ft), 5 ft, 5 ft)". Similarly, the BPDS processes and transforms a stream of bit maps received over time, for example, "0000100010" at 10.00 am and "0010000010" at 10.05 am, to identify that the "human moved from coordinates (3 ft, 5 ft, 5 ft) to (4 ft, 4 ft, 5 ft)".

The biomechanical parameter determination system (BPDS) further computes the speed and acceleration of the human movement based on approximations for distances, for example, "human is moving at a speed of 1 meter/sec and a vertical acceleration of 0.1 meter per second squared". Based on this motion data, the BPDS computes whether the human has experienced a fall, using the data of the past 5 minutes to result in a data output of "fall—no", and any health risk factors that are indicated by the movement, as averaged over a week or a month, as "fall risk—no". The functions of the BPDS cannot be performed by a generic computer program running on a generic computer.

The biomechanical parameter determination system (BPDS) dynamically receives 102 second data comprising, for example, optical images, and/or sound data, and/or amplitude, and/or distance of the target objects in the region from one or more second sensors positioned in one or more different spatial directions in the region, over the network. In an embodiment, sound is an additional input in the second data for improving accuracy of determination of one or more biomechanical parameters, for example, fall associated with each of the target objects in the region. The amplitude and the distance of the target objects are measured from the location of the second sensors. The second sensors comprise, for example, one-dimensional and two-dimensional optical sensors such as optical cameras, ultrasound sensors, audio sensors, etc. The second data comprises, for example, intensity values or voltage values corresponding to ultrasound frequencies, for example, a 444 kilo Hertz (kHz) frequency for ultrasound sensing. In an embodiment, the ultrasound sensors are positioned in one or more arrays and used in conjunction with other devices, for example, radio frequency identification (RFID) tags, position sensing devices, motion sensors, etc., for detecting one or more target objects in the region and generating output data. Ultrasound sensors provide radial distance measurement based on time of flight. Using arrays of ultrasound sensors or mounting an ultrasound sensor on a mechanically rotating fixture provides multiple radial distances and thence an image of the surrounding region. If the second sensors are ultrasound sensors, then the BPDS processes ultrasound data in a Doppler mode where a time difference of subsequent ultrasound line data is combined to generate the motion data. If the second sensor is an optical camera, the second data represents optical images of the region. The second data from an optical camera comprises, for example, color values, or intensity values, or voltage values corresponding to a visible or infrared spectrum, etc., or any combination thereof. In an embodiment, the BPDS determines motion information from the optical camera. In an embodiment, the BPDS obtains the second data without processing as raw data from the second sensors. In an embodiment, some processing is provided, such as receiving data output by a detector or an estimator without further processing.

The biomechanical parameter determination system (BPDS) obtains position information of the target objects from the first sensors, for example, the pyroelectric infrared (PR) sensors and/or the position information of the target objects from the second sensors, for example, the camera sensors and/or the optical sensors. For example, the BPDS obtains the angular position and size information of a moving target object from the first data, for example, PIR sensor data received from the PIR sensors. The BPDS performs a motion analysis of camera data and/or optical data received from the camera sensors and/or the optical sensors to determine the position and posture information of the moving target object. The BPDS generates a three-dimensional (3D) model of the moving target object using the PIR data and the camera data and/or the optical data. The BPDS performs a time evolution of the 3D model to determine the orientation and motion information of the moving target object. The BPDS obtains the biomechanical parameters from the position and motion analysis of the moving target object. Furthermore, from the orientation of the moving target object and a time analysis of the events that led to a change of orientation of the moving target object, the BPDS determines an occurrence of a fall. Using the second sensors, for example, the ultrasound sensors or the optical cameras along with the first sensors, for example, the arrays of PR sensors improves the accuracy of detection and tracking of the motion of the target objects.

The optical images, and/or the sound data, and/or the amplitude, and/or the distance of the target objects in the region received from the second sensors have different data formats and are processed differently and independently to obtain or confirm the first data. The biomechanical parameter determination system (BPDS) transforms the second data received from the second sensors as follows. The BPDS receives optical images from a camera or an optical sensor as a number of red, green and blue (RGB) picture frames per second or a movie file in a moving picture experts group-4

(MPEG-4) or MP4 or audio video interleave (AVI) format. The BPDS transforms the RGB pixel information in each image frame, for example, into "background, human, and parts of a human body—head, torso, limbs". The BPDS then computes the center of gravity of the head and with known information about the placement of the camera in the room, computes the x, y, z coordinates of the human in the room, for example, as "human detected at (3 ft, 5 ft, 5 ft)". The BPDS transforms the data from the frames over time to identify, for example, that the "human moved from coordinates (3 ft, 5 ft, 5 ft) to (4 ft, 4 ft, 5 ft)". Similarly, in the embodiment where the BPDS is implemented within a second sensor such as a microphone or an ultrasound sensor, the BPDS processes and transforms the sound data received from the microphone or the ultrasound sensor to identify the location of a moving target object, if any, and computes the distance from the BPDS using the Doppler effect, for example, as 10 ft radial distance from the BPDS.

In an embodiment, the biomechanical parameter determination system (BPDS) detects the sound data from the room using two different sensors, for example, microphones and ultrasound sensors. These sensors transform the sound data into a digitized stream of amplitude and frequency data that are processed by standard software drivers provided by hardware manufacturers or software libraries of the computer operating system employed by the BPDS. In an embodiment, the BPDS processes the amplitude and frequency data using a third party software to identify any audible sounds or words of interest, for example, "Yes", "Help", or cries for help. The BPDS compares the sounds, words, or phrases with a database of phrases that are of interest and implements a software algorithm to determine the course of action. For example, if the sound heard is "Help", the BPDS creates one or more emergency alerts that are transmitted to a user who is authorized to receive the emergency alerts. The BPDS transforms the input data, for example, "Help", and creates an alert that "Mr. XYZ at address YYY is requesting help".

In another embodiment, the biomechanical parameter determination system (BPDS) generates and directs an ultrasound pulse of, for example, 40 kilohertz (kHz) that bounces off all the objects in a field of view of a region, for example, a room, including those objects that may be occluded, but are reached by the reflecting ultrasound waves. The second sensors capture some of these reflected sound waves that reach the second sensors within a few milliseconds of transmission. The BPDS calculates the time difference using a software driver provided by a hardware manufacturer. The BPDS then detects how far a target object is from the second sensor based on the time difference, using a formula, for example, distance=speed of sound*time/2. For example, the BPDS generates an ultrasound pulse of 40 kHz when no target object is identified, obtains a time difference of 13.41 milliseconds (ms) for the reflected ultrasound waves to come back, and calculates the distance measured as 2.3 meters. The BPDS then generates an ultrasound pulse at a later time. The BPDS detects the new time taken as 6.41 ms and calculates the new distance as 1.1 m. The BPDS then confirms that there is a target object in the room and is at a distance of about 1.1 m. There is no standardized software that computes the distance of a target object in a room based on the incoming data in accordance with the method steps disclosed above.

In an embodiment, the biomechanical parameter determination system (BPDS) within or external to the second sensors processes the second data, for example, red, green and blue (RGB) color model data, etc., with a spatial filter or a temporal filter. In another embodiment, if one of the second sensors is, for example, an ultrasound sensor, the BPDS obtains the second data without processing. In another embodiment, some processing is provided such as receiving data output by a detector, a Doppler processor, a distance estimator or a detector and an estimator without further processing. The BPDS obtains the position information from the first sensors, for example, the pyroelectric infrared (PIR) sensors and/or time-amplitude data from the second sensors, for example, the ultrasound sensors. The BPDS determines distance of the moving target object from the sensor location via Doppler processing of the ultrasound time-waveform data. The BPDS generates a three-dimensional (3D) model of the moving target object using the pyroelectric infrared (PIR) data and the ultrasound data. The BPDS performs a time evolution of the generated 3D model to determine the orientation and motion information. The BPDS determines the biomechanical parameters from the position and motion analysis of the moving target object. Furthermore, from the orientation of the target object and a time-analysis of the events that led to a change of orientation of the target object, the BPDS determines an occurrence of a fall.

The one-dimensional and two-dimensional arrays of the first sensors and the second sensors are oriented in the same direction or in different directions to ensure maximum coverage of a region of interest, to minimize impact of occlusions, and to obtain volumetric and three-dimensional (3D) data. The first sensors and the second sensors are positioned in different planes to cover a maximum region and obtain spatial data and temporal data of the target objects with a high accuracy and reliability. In an embodiment, the biomechanical parameter determination system (BPDS) processes and transforms the first data from the arrays of first sensors to digital signals. The BPDS processes the first data, for example, temperature data, motion data, position information, etc., from one or more first sensors, in combination with the second data, for example, distance, amplitude information, sound, and visual information from one or more second sensors, for example, the ultrasound sensors, the optical cameras, audio sensors, etc., to determine the temperature, motion, sound, orientation, and position of the target objects.

The biomechanical parameter determination system (BPDS) stores the dynamically received first data of the target objects and the dynamically received second data of the target objects in one or more databases. In an embodiment, the BPDS processes the dynamically received first data and the dynamically received second data in real time without storing the dynamically received first data and the dynamically received second data. The BPDS receives the first data and/or the second data during real time imaging, for example, obtaining data when a human moves in a region of interest. In an embodiment, the BPDS receives the first data and the second data from a memory unit, for example, a single device or a group of devices such as one or more of a buffer, a cache, a random access memory (RAM), removeable media, hard drive, a magnetic memory, an optical memory, etc. For example, the BPDS receives the first data and the second data from a database of images, or after a motion has occurred, or from a data transfer from an external communication device. In another embodiment, the BPDS receives the first data and the second data, for example, by requesting for the first data and the second data from an external communication device, loading the first data and the second data from a memory unit, receiving the first data and the second data from sensors, recording the first data and the second data, etc. The BPDS formats the first data and the second data for display on a display unit in a compatible format, for example, a polar coordinate format, an acquisition format, etc.

The biomechanical parameter determination system (BPDS) obtains a time history of the position and orientation data at a predetermined time interval, for example, 100 millisecond intervals from the first data and the second data. The BPDS stores the raw data from the sensors and the motion, position, sound, and orientation data in a local memory unit, and also in an embodiment, communicates the position and orientation data periodically, for example, at five minute intervals to a global memory unit on a cloud server in a cloud computing environment. As used herein, "cloud computing environment" refers to a processing environment comprising configurable computing physical and logical resources, for example, networks, servers, storage, applications, services, etc., and data distributed over a network. The cloud computing environment provides on-demand network access to a shared pool of the configurable computing physical and logical resources. On the occurrence of an event, for example, a fall event, the BPDS stores the time history of the position and orientation data for a predetermined time interval, for example, a five or ten-minute interval prior to and after the occurrence of the event in a local memory unit or communicates the time history to the cloud server in the cloud computing environment.

In an embodiment, the biomechanical parameter determination system (BPDS) employs fault tolerant mechanisms locally to provide data integrity. In an embodiment, the BPDS implements the fault tolerance mechanism at the sensors, and/or at the local processor, and/or on the cloud server. The BPDS identifies faulty sensors in the local processor software by utilizing sensor patterns and sensor diagnostics. The sensor patterns comprise, for example, patterns that define that a sensor is always on or always off or that sensor information of a neighbor sensor is contradicting the current sensor information. The fault tolerance at the local processor compensates for failures in the software and data transfer. The BPDS handles a software failure by event history and auto-recovery methods provided by the operating system and the algorithm implemented by the BPDS. The BPDS handles the data transfer failures by using a minimum of two local circular buffers. One of the local circular buffers stores periodic data and the other local circular buffer stores critical data, for example, a fall event. The BPDS clears the data stored in local buffers when the data is transferred to the cloud server and writes over the data if the local buffers reach the maximum storage limit. If there is a failure in network communication, the BPDS compresses the local circular buffers and saves the data as backup files. The BPDS initiates the transfer of the backup files once the connectivity to the cloud server is re-established. The fault tolerant mechanism in the cloud computing environment utilizes multiple servers to receive, store, and process the data. If one server fails to receive or store or process the data, backup servers take over the functions to maintain the communication.

The first data, for example, temperature data, motion data, etc., and the second data, for example, sound data, etc., of the target objects received from the sensors, for example, a pyroelectric infrared (PIR) sensor, an ultrasound sensor, audio sensors, etc., are processed and executed by an algorithm in the biomechanical parameter determination system (BPDS) for determining biomechanical parameters of one or more target objects in a region for detecting and monitoring a fall, walking speed, and position of the target objects and storing data related to the fall, walking speed, and position of the target objects. A generic computer using a generic program cannot interface instantaneously with the sensors located in the region of interest where the biomechanical parameters and other activities of the target objects are detected and monitored.

The biomechanical parameter determination system (BPDS) filters 103 the dynamically received first data and the dynamically received second data of the target objects using digital signal and image processing techniques. The digital signal and image processing techniques comprise, for example, spatial filtering using a spatial filter and temporal filtering using a temporal filter. The spatial filter is, for example, a spatial smoothing filter, or a threshold based on intensity or a temperature value, or a frequency domain filter, etc. The temporal filter is, for example, a temporal smoothing filter, or a threshold based on intensity or a temperature value, or a frequency domain filter, etc. In an embodiment, the BPDS filters the dynamically received first data and the dynamically received second data of the target objects by spatially filtering the dynamically received first data and the dynamically received second data of the target objects using the spatial filter. The BPDS performs spatial smoothing, error handling, etc., and rejects bad data to enhance data of one array of sensors using the data from another array of sensors. The BPDS uses the data received from one array of first sensors or second sensors to enhance the data received from another array of first sensors or second sensors by adapting spatial smoothing and error handling, and rejecting bad data.

In an embodiment, the biomechanical parameter determination system (BPDS) performs morphological image processing on the dynamically received first data and the dynamically received second data of the target objects using a morphological image processing unit in operable communication with the spatial filter. The morphological image processing unit implements a morphological image processing function comprising, for example, region dilation, erosion, and skeletonization. A region dilation method reconstructs a human image from images of smaller separate body parts, for example, head or torso that are viewed in the raw optical image data. An erosion method makes boundaries of a human target object thinner to obtain a skeleton, which in turn provides the location and orientation of the human target object. Skeletonization refers to a process of performing a repeated sequence of erosion and region dilation to obtain a skeleton of a human target object. The skeleton is subsequently used to obtain the location and orientation of the human target object. The morphological image processing unit identifies features, for example, the relative position of features such as the center of the head, the position and orientation of the limbs and body, etc., of the human target object. The morphological image processing unit also performs image preprocessing to remove shadows, and reflections. The spatial smoothing filter is, for example, a median filter, a moving average filter, or a Gaussian filter. In an embodiment, the spatial filter implements frequency domain filtering and spatial domain filtering or processing methods. The BPDS employs frequency domain filtering and spatial domain processing to remove noise spikes that are common in video or still images, to remove artifacts, for example, shadows and false objects that occur due to variations in lighting conditions of the video and still images, etc.

In another embodiment, the biomechanical parameter determination system (BPDS) filters the dynamically received first data and the dynamically received second data of the target objects by temporally filtering the dynamically received first data and the dynamically received second data of the target objects using the temporal filter. In an embodiment, the BPDS performs morphological image processing on the dynamically received first data and the dynamically received second data of the target objects using the morphological image processing unit in operable communication with the temporal filter. The shape of the skeleton varies with time due to changes in ambient lighting conditions. The BPDS performs a persistence based temporal filtering of the morphology data and the results of the morphological image processing, for example, the skeleton, to remove variations in the target object that arise due to lighting conditions or shadows or unreal changes of the target object within short time intervals, for example, 100 millisecond intervals. The BPDS uses a typical moving average filter for performing the persistence based temporal filtering.

The biomechanical parameter determination system (BPDS) utilizes the temporal filter for spatial smoothing and thresholding functions. The BPDS implements spatial smoothing using the temporal filter for removing random noise in an image. The BPDS implements motion thresholding using the temporal filter for removing stationary objects, small motions, and slow drifts in ambient light in an image. The temporal smoothing filter comprises, for example, a median filter, a moving average filter, or a Gaussian filter. In an embodiment, the temporal filter implements frequency domain filtering methods. Slow motion of a target object has low Doppler frequencies or small image areas and therefore appears in low frequencies in the frequency domain. Random noise typically has equal contributions at all frequencies. The BPDS persists or averages the image data or morphological skeleton data in a time domain or a frequency domain to reduce the noise. Selection of some frequency bands differentiates moving human target objects, that is, a range of expected velocities from normal human motion, from other imaging or Doppler or thermal artifacts such as noise, from slow drifts in ambient light or ambient temperature, or from vibrations. The BPDS utilizes the temporal filter for performing persistence and thresholding functions. In an example, when a target object such as a human turns off a light in a room, the brightness of the captured image changes instantaneously and is subsequently interpreted as large changes in the location of the target object and size of the target object. The large changes comprise, for example, a fall event or disappearance of the target object from the field of view. The BPDS performs persistence functions to make the changes slower with time, and the algorithm implemented by the BPDS adapts to the change in ambient light. The BPDS performs temporal smoothing, error handling, etc., and rejects bad data to enhance data of one array of sensors using data from another array of sensors. A generic computer using a generic program cannot filter the dynamically received first data and the dynamically received second data of the target objects in accordance with the method steps disclosed above.

The biomechanical parameter determination system (BPDS) identifies 104 one or more target objects comprising moving objects and stationary objects in the region using the temperature data and/or the motion data of the target objects in the region extracted from the filtered first data. The BPDS identifies one or more target objects in the region by estimating temperature and/or motion of each of the target objects in the region based on a predetermined threshold range, for example, a predetermined temperature threshold range and/or a predetermined motion threshold range. As used herein, the "predetermined temperature threshold range" refers to a temperature range used for identifying target objects in different categories, and the "predetermined motion threshold range" refers to a motion range used for identifying target objects in different categories. For example, humans have a temperature range between about 96 degrees Fahrenheit to about 100 degrees Fahrenheit which differs from normal room temperature or the temperature of hot target objects in a region, for example, a room. The BPDS utilizes the size and temperature of the target objects to differentiate the human target objects from other target objects. A speed range for normal walking of the human is, for example, between about 0.1 meters per second to about 1.5 meters per second, whereas the other target objects remain stationary. In an embodiment, the BPDS utilizes the walking speed of the target objects to differentiate the human target objects from other target objects. In an embodiment, the BPDS applies stereoscopic methods to obtain three-dimensional (3D) representation of the processed data. Stereoscopic methods create or enhance the illusion of depth in an image by means of stereopsis for binocular vision. The stereoscopic methods generate two offset images separately to a left eye and a right eye of a viewer. These two-dimensional images are then combined to generate the perception of 3D depth. The BPDS utilizes multiple sensors at different spatial locations to triangulate the location of a target object. Based on the information of spacing of the sensors and their relative orientation, the BPDS obtains a 3D model of the imaged space. Subsequently, the BPDS computes the 3D location of the target object. A generic computer using a generic program cannot identify one or more target objects in the region using temperature data and/or the motion data in accordance with the method steps disclosed above.

The biomechanical parameter determination system (BPDS) determines 105 one or more of multiple biomechanical parameters associated with each of the identified target objects in the region using the filtered first data and/or the filtered second data for emergency alerting and/or health assessment. The biomechanical parameters comprise, for example, positions of the identified target objects in the region, acceleration of each of the identified target objects, walking speed of each of the identified target objects, and fall and posture of each of the identified target objects. In an embodiment, the BPDS determines the biomechanical parameters associated with each of the identified target objects in the region as follows: The BPDS determines 105*a* positions of the identified target objects in the region and tracks 105*a* the determined positions of the identified target objects as a function of time to generate position-time values. In an embodiment, the BPDS determines the positions of each of the identified target objects by thresholding the motion data. For every instance of a captured image, the BPDS identifies multiple target objects based on their relative spatial locations. Using multiple instances, for example, motion history or multiple image frames, the BPDS tracks each target object in time. For example, the BPDS subtracts the stationary background from an image to identify moving target objects using preconfigured thresholds to avoid noise. The BPDS identifies multiple points in the identified target objects. If the obtained data is an image, the BPDS subtracts the background image to obtain multiple image points within each target object. The BPDS estimates a centroid or a center of mass of each target object to obtain the position of the target object. The BPDS identifies individual target objects based on the predetermined temperature threshold of the target objects.

The biomechanical parameter determination system (BPDS) determines 105*b* speed of motion of each of the identified target objects extracted from the filtered first data and/or the filtered second data, using the generated position-time values. The determined speed of motion of each of the identified target objects is a time gradient of determined positions of each of the identified target objects. As used herein, "time gradient" refers to a function of time. In an embodiment, the BPDS determines the time gradient using temporal smoothing before and after gradient estimation. In another embodiment, the BPDS determines the time gradient by computing speed as a slope estimation over time. In an embodiment, the BPDS determines the speed of motion of each of the identified target objects by curve-fitting the generated position-time values. The BPDS utilizes a curve-fitting process to remove noise spikes caused by random errors in position estimation, and also to obtain trends in motion that are not influenced by rapid short motions, for example, during exercise. The BPDS determines 105*c* acceleration of each of the identified target objects using the generated position-time values or the determined speed of motion of each of the identified target objects. The determined acceleration is a time gradient of the determined speed of motion of each of the identified target objects. In an embodiment, the BPDS determines the time gradient using temporal smoothing before and after gradient estimation. In another embodiment, the BPDS determines the time gradient by computing speed as a slope estimation over time. In an embodiment, the BPDS determines the acceleration of the identified target objects using a second differential of the position of the identified target objects with respect to time. In another embodiment, the BPDS determines the acceleration of the target objects by curve fitting velocity-time values or location-time values.

The biomechanical parameter determination system (BPDS) determines 105*d* walking speed of each of the identified target objects using the determined speed of motion of each of the identified target objects based on walking criteria. The walking criteria comprise, for example, a falling condition, a running condition, a normal walking condition, an intent based walking condition, etc. Walking speed is an indicator for health assessment and a vital sign in health monitoring that is correlative to overall survival and a multitude of functional capacities comprising, for example, walking, cognitive capacity, and ability to live independently in seniors. The BPDS removes outliers, for example, by differentiating between falling and running, differentiating normal walking from intent based walking as performed during an exercise by the identified target objects, etc. The BPDS uses templates of existing patterns, for example, position and time for activities comprising, for example, falling, running, and intent based walking to differentiate between the activities. The BPDS determines 105*e* fall and posture of each of the identified target objects using one or more of the determined speed of motion of each of the identified target objects, the determined acceleration of each of the identified target objects, and rapid change in the determined positions of each of the identified target objects, for example, in a time period of about 500 milliseconds, followed by a predetermined time period of inactivity, for example, 1 minute, by each of the identified target objects. Fall typically occurs as an involuntary act, for example, a natural fall with an acceleration that corresponds to gravity, and therefore exhibits large accelerations used by the BPDS to determine a fall, unlike a simulated or controlled fall that has different acceleration values than free fall. Based on the determination of the fall and the posture of each of the identified target objects, the BPDS alerts a respondent, for example, a caretaker, 911 type emergency service facilities, a health assistant, a senior home, a nursing facility, etc., in real time.

The biomechanical parameter determination system (BPDS) performs spatial analysis of the determined positions of each of the identified target objects to determine the posture of each of the identified target objects by comparing the determined positions of each of the identified target objects with a template of posture patterns stored in one or more databases. The posture patterns comprise patterns associated, for example, with standing, sitting, lying down, walking, stretching, etc. The spatial analysis comprises, for example, spatial filtering, spectral analysis of the determined positions of each of the identified target objects, etc. The spatial analysis is performed as follows. The BPDS identifies the relative locations of different body parts within the skeleton, and then identifies the shape of the skeleton, for example, a straight line, or a U-shape, or an S-shape, etc. The BPDS then normalizes the shape of the skeleton with respect to spatial dimensions, for example, height in meters to compare with the stored posture patterns. The BPDS then compares the coordinates of the body parts and the normalized shape of the skeleton to the existing template of posture patterns. The matching of the shape of the skeleton with a posture pattern indicates the posture of the human target object, for example, the posture associated with standing, or sitting, or lying down, or walking, or stretching, etc., with a reasonable probability. The BPDS performs a skeletonization of the moving target object to obtain information of the body parts of the target object and determines the posture of the target object using the relative locations of the body parts.

In an embodiment, the biomechanical parameter determination system (BPDS) performs a gait analysis based on the posture of an identified target object walking in a region, for example, a room. The BPDS determines disease conditions based on the gait of the identified target object. For example, if the target object swings significantly sideways while walking, the BPDS determines hip arthritis. As speed of motion, number of steps per minute, walking speed, posture, etc., are indicators of various disease conditions, the BPDS utilizes these biomechanical parameters to determine disease conditions, for example, neurological disorders, musculoskeletal disorders such as spinal stenosis, etc. For example, if the biomechanical parameters determined by the BPDS indicate a loss of symmetry of motion and timing between left and right sides of the target object, the BPDS determines, for example, unilateral neurologic or musculoskeletal disorders such as a limp caused by a painful ankle. If the biomechanical parameters determined by the BPDS indicate unpredictable or highly variable gait cadence, step length, or stride width, the BPDS determines a breakdown of motor control of gait due to a cerebellar or frontal lobe syndrome. When the target object first starts walking, if the biomechanical parameters determined by the BPDS indicate that the target object's feet are fixed to a floor, typically because the target object is not shifting his/her weight to one foot to allow the other foot to move forward, the BPDS determines an isolated gait initiation failure, Parkinson's disease, or frontal or subcortical disease. If the biomechanical parameters determined by the BPDS indicate that the identified target object is walking backwards when initiating gait or falling backwards while walking, the BPDS determines frontal gait disorders, Parkinsonism, progressive supranuclear palsy, etc. If the biomechanical parameters determined by the BPDS indicate toe dragging or a stepping gait, that is, an exaggerated lift of the leg to avoid catching the toe, the BPDS determines secondary to anterior tibialis weakness caused by trauma to the peroneal nerve at the lateral aspect of the knee or a peroneal mononeuropathy typically associated with diabetes, spasticity of calf muscles, or lowering of the pelvis due to muscle weakness of the proximal muscles on the stance side. Similarly, the BPDS determines other disease conditions based on the biomechanical parameters of a target object.

In an embodiment, the biomechanical parameter determination system (BPDS) determines a fall by performing a time analysis of the positions of the target objects. In an embodiment, the BPDS records the time of occurrence of the determined fall of each of the identified target objects, the location of occurrence of the determined fall, the speed of the determined fall, the acceleration associated with the determined fall, and a pattern of the determined fall, for example, spatial locations, etc., in one or more databases. The falls of interest typically have a temporal pattern that involves a period of normal motion followed by rapid motion, for example, typically less than 1 second, followed by a period of inactivity, for example, more than 10 seconds. Furthermore, a fall to the ground occurs in walkways or in slippery environments, for example, a kitchen, a restroom, etc. The BPDS identifies the environment, for example, the type of a room by a learning process using activity patterns over a period of time, for example, one week or one month. The BPDS utilizes a combination of the temporal pattern of the fall with the spatial location of the occurrence of the fall to remove outliers and improve the accuracy of determining falls. The BPDS identifies and stores falls in one or more databases. In an embodiment, the BPDS determines a severity level of the determined fall of each of the identified target objects by comparing a pattern of the determined fall with predetermined template patterns of falls stored in one or more databases. Furthermore, the BPDS categorizes the falls into different severity levels, for example, using inputs from experts. The BPDS uses a classical pattern classifier or deep learning methods to identify the patterns that contribute to the categorization. For example, the pattern classifier utilizes discriminant analysis of the data in the form of past input falls and corresponding severity levels to identify key patterns in the inputs that lead to the outcomes. Subsequently, for a new fall, the BPDS identifies the pattern and the expected severity level. The BPDS employs a deep learning method to automatically identify key patterns that relate the past input falls to the corresponding severity levels. Subsequently, a deep learning neural network predicts the severity levels for a new fall.

The biomechanical parameter determination system (BPDS) determines different types of a fall, for example, a forward fall, a backward fall, a fall of a target object among multiple target objects in a region, a fall of a target object with a partial obstruction from a non-target object, a fall of an unconscious target object, a fall of a target object partially out of view, a fall of a target object in a dark room, etc. The BPDS differentiates a fall that could lead to an injury or death from a typical fall related to a regular activity performed by the user, for example, falling onto a couch to rest. The BPDS utilizes activity patterns over a learning period of time, for example, about 2 weeks to about 3 weeks, etc., to calibrate regular user activity patterns and utilizes prior learned activity patterns from multiple users and multiple scenarios that differentiate many use cases of regular falls and dangerous falls.

In an embodiment, the biomechanical parameter determination system (BPDS) utilizes sound data in the second data received from the second sensors, for example, audio sensors to improve the determination of the biomechanical parameters associated with each of the identified target objects in the region. The audio sensors provide a sound input, for example, sound feedback to the BPDS from the region of interest. The BPDS filters the incoming sound to remove ambient noise and also any sound patterns expected at a particular time of the day in that region, based on a prior history of sounds. The BPDS splits the filtered sound data into sound snippets. That is, the BPDS chunks the filtered sound into sound snippets. Furthermore, the BPDS independently analyzes the sound snippets against various locally stored sound templates, for example, a typical request, a cry for help, etc., and also analyzes the sound snippets for any irregular or unexpected patterns.

In an embodiment, the biomechanical parameter determination system (BPDS) utilizes the sound input from the audio sensors independently or in conjunction with other inputs of the first data and/or the second data to determine or improve accuracy of one or more biomechanical parameters comprising, for example, presence, positions, movements, acceleration, fall, etc., associated with each of the identified target objects in the region. In another embodiment, the BPDS transmits the sound snippets along with the time of occurrence, for further processing to a computer application in the cloud computing environment in real time or in a batch mode at a predetermined time interval, for example, at the end of the day, where having access to more processing power and large data sets allows the BPDS to compare the sound snippets against a broader set of sound templates and analyze the sound snippets with other inputs of the first data and/or the second data prevalent at the same time or preceding or succeeding the events of interest to gain further insights, and to improve detection algorithms executed in the cloud computing environment and in the BPDSs installed at customer sites.

In an embodiment, the biomechanical parameter determination system (BPDS) analyzes the sound snippets independently or in conjunction with the first data and/or another of the second data, along with preconfigured sound templates for the determination of the biomechanical parameters associated with each of the identified target objects in the region. When the BPDS detects a fall-like motion, through the analysis of the first data and/or the second data comprising the sound data, for example, noise from the fall of the target object's body, a cry for help, sound caused by the movement of the target object in the room, breaking of furniture, etc., the BPDS makes a preliminary assumption that a fall occurred. The BPDS stores patterns associated with sound, for example, the noise from the fall of the target object's body, a cry for help, sound caused by the movement of the target object in the room, breaking of furniture, etc., digitally on local onboard storage, for example, a memory unit or a database to be accessed for comparisons in real time.

In another embodiment, the biomechanical parameter determination system (BPDS) renders question prompts to the target objects in the region, interprets a response or a non-response to the question prompts to confirm a fall of an identified target object in the region, and alerts one or more respondents based on the interpretation via the network. For example, after making a preliminary detection of a fall, the BPDS proceeds to ask questions, for example, "Fall detected. Do you need help?" and let the target object in the room respond if he or she needs help. The BPDS considers an affirmative response, for example, a "Yes" as a request for help and generates an emergency alert. The BPDS cancels an emergency alert if there is a clear negation, for example, "No", but records the response and/or pattern for analysis.

The BPDS interprets a lack of a response, that is, a non-response as a situation where the target object is incapacitated, unable to communicate, and needs help, and triggers an emergency alert. The sound input coming from the target object is a confirmation of the accuracy of the interpretations made by the BPDS. A generic computer using a generic program cannot determine one or more biomechanical parameters associated with each of the identified target objects in the region using the filtered first data and/or the filtered second data for emergency alerting and/or health assessment in accordance with the method steps disclosed above.

In an embodiment, the biomechanical parameter determination system (BPDS) assesses health of each of the identified target objects in communication with a health template repository using the determined biomechanical parameters comprising, for example, the walking speed, the fall, and the posture associated with each of the identified target objects in the region. As used herein, the "health template repository" refers to a template repository with medical conditions comprising, for example, symptoms of a disease, diseases such as Alzheimer's, dementia, etc., general population trends, templates of walking speed, posture, and falls obtained from prior data or libraries, etc. The BPDS utilizes the determined walking speed of the identified target objects as a significant health signal to continuously monitor and assess the health status of the identified target objects, and to provide early warnings if health status declines occur, ultimately driving early intervention before irreversible deterioration or a fall occurs. In an embodiment, the BPDS utilizes fall and walking speed to assess overall health including progression of disease, recovery from disease, etc., and to identify various health risks and metrics comprising, for example, fall risk, cognitive declines, ability to live independently, and overall survival. The BPDS performs the health assessment using templates of normal and disease states.

In an embodiment, the biomechanical parameter determination system (BPDS) determines a fall risk of each of the identified target objects by performing a time analysis of the determined walking speed and/or the determined posture of each of the identified target objects. The time analysis involves comparing mean walking speeds over a period, for example, several months, and identifying time segments where either a large reduction in speed or a critical walking speed of, for example, about 0.5 meters per second (m/sec) is identified as a predictor of fall risk, identifying changes in posture over the identified time segments, and combining the information from the identified time segments and the identified changes in posture to identify the risk of a fall. The BPDS performs a time analysis by comparing the determined fall, posture, and walking speed with the health template repository and alerts the respondents via a network. The BPDS utilizes standard methods, for example, differencing with thresholds, goodness of fit methods, etc., for comparing the fall, the posture, and the walking speed with a predetermined template. The time analysis comprises rejecting outliers using statistical methods, for example, mean, standard deviation, median, goodness of fit, and mode. The outliers are due to bad data and an intent based motion, for example, exercise. The time analysis further comprises computing central tendencies over a period of time, for example, days, weeks, months, and years, where central tendencies comprise a mean, standard deviation, median, mode, correlation, etc. A generic computer using a generic program cannot assess health of each of the identified target objects using the determined biomechanical parameters in accordance with the method steps disclosed above.

The biomechanical parameter determination system (BPDS) utilizes the determined biomechanical parameters to provide alerts and alarms that indicate the occurrence of a fall, monitor the walking speed over a period of time, indicate the general health status to a respondent, for example, a senior home or nursing facility, and enable physicians to obtain clinically relevant data over a population of elderly people under non-clinical or normal conditions. The walking speed determination, fall and posture determination, etc., of the method disclosed herein are adaptive and comprise filtering and/or thresholding of first temperature and/or motion and/or position information of a target object for a first location of the target object at a first time; adapting the filtering and/or thresholding as a function of second temperature and/or motion and/or position information for a spatially and/or temporally adjacent location and/or time respectively; and determining a fall as a function of data output from the adapted filtering and/or thresholding. In an embodiment for identifying walking speed and/or fall of target objects using pyroelectric or passive infrared (PIR) sensors in combination with ultrasound sensors or optical cameras, the BPDS processes temperature and/or motion and/or position information of the target object from a PIR sensor location at a first time in combination with the distance and amplitude information from a first ultrasound sensor or with the visual information from an optical camera to obtain the temperature and/or motion and/or position of the target object. The BPDS processes the information from the same infrared and ultrasound sensors at a second time and a third time to obtain the temperature or motion or position information of the target object at the second time and the third time respectively. The processing performed by the BPDS comprises combinations of signal amplification, analog to detection conversion, filtering, thresholding, identifying position, identifying speed, identifying acceleration of the target object, etc. The BPDS generates a time sequence of the processed information, for example, (position, speed, acceleration) from the first time, the second time, and the third time.

In another embodiment for identifying walking speed and/or fall of target objects using pyroelectric or passive infrared (PIR) sensors in combination with ultrasound sensors or optical cameras, the biomechanical parameter determination system (BPDS) processes temperature and/or motion and/or position information from a PIR sensor at a first location at a first time in combination with the distance and amplitude information from a first ultrasound sensor or with the visual information from an optical camera to obtain the temperature and/or motion and/or position of a target object. The BPDS combines the processed information with processed information from a PR sensor at a second location for obtaining spatially, temporally, or spatially and temporally adjacent location, time, or location and time respectively. Subsequently, the BPDS generates a time sequence of images corresponding to combinations of position, velocity, and acceleration as a function of the data output from the combined filtering, thresholding, position identification, speed identification, acceleration identification, or combinations thereof.

In another embodiment for identifying walking speed and/or fall of target objects using pyroelectric or passive infrared (PIR) sensors in combination with ultrasound sensors or optical cameras, the biomechanical parameter determination system (BPDS) processes temperature and/or motion and/or position information from a PR sensor at a first location at a first time in combination with the distance and amplitude information from a first ultrasound sensor or with the visual information from an optical camera at a second location to obtain the temperature and/or motion and/or position of a target object. The BPDS combines the processed information with processed information from a PIR sensor at a second location for obtaining spatially, temporally, or spatially and temporally adjacent location, time, or location and time, respectively. The BPDS combines the processed information with the processed information from either an ultrasound sensor at a second location or a second optical camera for obtaining spatially, temporally, or spatially and temporally adjacent location, time, or location and time, respectively. The BPDS then generates a time sequence of images corresponding to combinations of position, velocity, and acceleration as a function of the data output from the combined filtering, thresholding, position identification, speed identification, acceleration identification, or combinations thereof.

In another embodiment for identifying walking speed and/or fall of target objects using pyroelectric or passive infrared (PIR) sensors in combination with ultrasound sensors or optical cameras, the biomechanical parameter determination system (BPDS) processes the temperature and/or position and/or motion information from a PR sensor at a first location at a first time in combination with the distance and amplitude information from a first ultrasound sensor or with the visual information from an optical camera to obtain the spatial and temporal information, that is, temperature and/or motion and/or position of a target object. The BPDS adapts the processed information with processed information from a PR sensor at a second location for obtaining spatially, temporally, or spatially and temporally adjacent location, time, or location and time, respectively. The BPDS adapts the processed information with the processed information from either an ultrasound sensor at a second location or a second optical camera for obtaining spatially, temporally, or spatially and temporally adjacent location, time, or location and time, respectively. The BPDS generates a time sequence of images as a function of the data output from the adapted filtering, thresholding, position identification, speed identification, acceleration identification, or combinations thereof.

In another embodiment, the biomechanical parameter determination system (BPDS) utilizes walking speed, fall, and posture for assessing the health of the target object and fall risk. In this embodiment, the BPDS performs a time filtering of the speed and posture data. Subsequently, the BPDS performs a short-time and long-time analysis of the data and computes statistics such as mean, standard deviation, median, and mode. The BPDS then compares these statistics with known templates of healthy and diseased states. The BPDS computes the biomechanical parameters that assess the overall health of the target object based on the statistics and the comparison with the templates.

In an embodiment, the biomechanical parameter determination system (BPDS) thresholds and averages the first data using spatial filters and temporal filters. The BPDS utilizes a temperature threshold and a spatial average to estimate the temperatures of the target object and estimate the location of the target object. The BPDS also performs thresholding and speed determination. In different embodiments, the BPDS subsequently estimates the walking speed, and/or the posture of the target object, and/or the occurrence of a fall of the target object.

The BPDS generates alerts that indicate an occurrence of the fall, and/or a health status, and/or a fall risk using the determined biomechanical parameters and transmits the generated alerts to one or more respondents, for example, a caretaker, 911 type emergency service facilities, a health assistant, a senior home, a nursing facility, devices, etc., about the fall via the network for timely intervention. The BPDS alerts a respondent via an audio mode, for example, an alarm, etc., or a visual mode, for example, a text message, etc. The BPDS sends alarms or alerts as a function of the determined biomechanical parameters, for example, the fall or walking speed or temperature associated with a target object.

The biomechanical parameter determination system (BPDS) implements one or more specific computer programs to determine the biomechanical parameters, for example, positions, speed of motion, acceleration, walking speed, fall, and posture of the target objects. The BPDS collects data from the sensors and transforms the collected data from the sensors to eliminate noise data and enhance the accuracy of the determination of the biomechanical parameters, and further processes the transformed data to detect positions, speed of motion, acceleration, walking speed, fall, and posture of the target objects, and from this information, through the use of other, separate and autonomous computer programs, the BPDS monitors the fall risk and health status of the target objects.

The data inputted to the biomechanical parameter determination system (BPDS), for example, temperature data, motion data, optical images of the target object, sound data, and amplitude and distance of the target object with respect to the sensors is transformed, processed, and executed by an algorithm in the BPDS. The BPDS processes and transforms the temperature data, the motion data, the optical images of the target object, the sound data, etc., as disclosed above. In an embodiment, the BPDS transforms the angular position and size information of a moving target object obtained from the first data and the position and posture information obtained from the second data into a three-dimensional (3D) model of the moving target object. The BPDS employs the morphological image processing unit to transform the first data and the second data to a relative position of features such as the center of the head, the position and orientation of the limbs and body, etc., of a target object. The BPDS transforms the data received from the sensors and generates a 3D image of the target object to determine the biomechanical parameters of the target object.

The method disclosed herein improves the functionality of the computer and provides an improvement in computer related technology related to determination of biomechanical parameters of one or more target objects as follows: On implementing the method disclosed herein, the biomechanical parameter determination system (BPDS) identifies the status of the target object in a region and provides emergency alerting to a respondent to prevent the risk of a fall under different severity levels. The BPDS determines an occurrence of a fall from the orientation of the target object in a region. The temperature data, motion data, sound data, amplitude and distance of the target object obtained from different types of sensors operably coupled to the BPDS determine the orientation of moving target objects. The BPDS stores the received data from different sensors in a local memory unit or in a cloud computing environment that constantly monitors the target object in a region. The BPDS utilizes morphological image processing techniques on the received data to further identify the features of the target object in a region.

In the method disclosed herein, the biomechanical parameter determination system (BPDS) processes and transforms all the visual and auditory information in a field of view received from the sensors to a digitized stream of data using hardware sensors, software drivers, and libraries provided by hardware manufacturers. The BPDS transforms the first data and the second data received from the sensors to identify the presence of a target object, for example, a human, and determine the position, speed, and acceleration of the target object in the field of view. A generic computer using generic software programs does not provide capabilities to transform the data easily and generate meaningful insights about the data that assist a respondent to take action. Furthermore, the BPDS utilizes historical data and comparative data, for example, from scientific studies or from other seniors as another layer to correct data errors and compute health risk factors.

The biomechanical parameter determination system (BPDS) improves confidence in the data by reducing errors, for example, both false positives and false negatives. The information from the second data is sometimes similar to that obtained from the first data and that is intentional. The BPDS utilizes the first data and the second data independently or together to compute the presence of a human, and determine the position, speed, and acceleration of the human in the field of view. If both the first data and the second data are available, the BPDS reduces the false positives by calculating the difference between the position information computed from the first data and the position information computed from the second data and estimates the probability of an error. For example, if the first data shows that a human was moving at a speed of 15 m/sec, and the second data shows that the human was moving at a speed of 1.2 m/sec, the BPDS rules out the former as an error, identifies the source of the erroneous data, and flags that particular sensor as defective.

The focus of the method and the biomechanical parameter determination system (BPDS) disclosed herein is on an improvement to sensor and computer functionalities, and not on tasks for which a generic computer is used in its ordinary capacity. Accordingly, the method and the BPDS disclosed herein are not directed to an abstract idea. Rather, the method and the BPDS disclosed herein are directed to a specific improvement to the way the processors in the BPDS and the sensors operate, embodied in, for example, filtering of the first data and the second data of the target objects received dynamically from the first sensors and the second sensors respectively, identification of the target objects in a region using the temperature data and the motion data of the target objects in the region extracted from the filtered first data, and determination of one or more of the biomechanical parameters associated with each of the identified target objects in the region.

In the method disclosed herein, the design and the flow of data and interactions between the first sensors, the second sensors, and the biomechanical parameter determination system (BPDS) are deliberate, designed, and directed. The data received from the first sensors and the second sensors is processed by the BPDS to steer the BPDS towards a finite set of predictable outcomes. The BPDS implements one or more specific computer programs to determine one or more of the biomechanical parameters associated with each of the identified target objects in a region. The interactions between the first sensors, the second sensors, and the BPDS allow the BPDS to collect data comprising the temperature data, the motion data, optical images, sound data, and amplitude and distance of the target objects with respect to the sensors in the region. From this data, the BPDS, through the use of other, separate and autonomous computer programs, transforms the data, identifies the target objects, and determines the biomechanical parameters comprising, for example, the motion, position, inactivity period, posture, etc., associated with each of the identified target objects. This determination is used as a trigger to detect a fall and the BPDS alerts the respondent's device about the fall. To dynamically receive first data comprising the temperature data and/or the motion data of the target objects in the region from the first sensors, dynamically receive second data comprising optical images, sound data, and amplitude and distance of the target objects in the region from the second sensors, filter the dynamically received first data and the dynamically received second data of the target objects, identify the target objects in the region, determine one or more of the biomechanical parameters comprising, for example, positions, speed of motion, acceleration, walking speed, inactivity period, fall, posture, etc., associated with each of the identified target objects in a region, and alert the respondent's device about the fall or the fall risk and health status of the identified target objects requires seven or more separate computer programs and subprograms, the execution of which cannot be performed by a person using a generic computer with a generic program. The steps performed by the BPDS disclosed above are tangible, provide useful results, and are not abstract. The software implementation of the BPDS is an improvement in computer related technology.

Consider an example where arrays of first sensors, for example, passive infrared (PR) sensor arrays are integrated with second sensors, for example, an optical camera device and an ultrasound device in a region for determining biomechanical parameters of target objects, for example, humans in the region. The PIR sensor arrays provide human motion information and also provide the spatial location and time of motion occurrence. Depending on the configuration of the sensors, the sensors provide, for example, two-dimensional (2D) position information of a moving human object for a compact form factor, and three-dimensional (3D) position information of the moving human object for a distributed network of the PR sensors. The ultrasound device provides one-dimensional (1D) radial distance information of either a static human object or a moving human object. The optical camera device provides 2D position information of the static human object or the moving human object. Combining the information from the PIR sensor arrays and the ultrasound device and/or the optical camera device provides the 3D position information of the human object. A temporal analysis of the PIR sensor arrays and the ultrasound device data and/or the optical camera device data provides the speed, acceleration, fall and posture information of the human object within a field of view of the optical camera device.

An example snippet of data received from the passive infrared (PIR) sensor arrays that is provided as input to the processor of the biomechanical parameter determination system (BPDS) for execution is provided below:

data_packet: 1111101011111111110101010101010000, 1373490826939,9200 data_packet: 1011101010000000110101010101010000, 1373490827039,9300 data_packet: 1011101010000000110101010101010000, 1373490827139,9400 data_packet: 1011101010000000110101010101010000, 1373490827239,9500 data_packet: 1011101010000000110101010101010000, 1373490827339,9600
data_packet: 1011101010000000110101010101010000, 1373490827439,9700
data_packet: 1011101010000000110101010101010000, 1373490827539,9800
data_packet: 1011101010000000110101010101010000, 1373490827639,9900
data_packet: 1011101010000000110101010101010000, 1373490827739,10000
data_packet: 1011101010000000110101010101010000, 1373490827839,10100
data_packet: 1011101010000000110101010101010000, 1373490827939,10200
data_packet: 1011101010000000110101010101010000, 1373490828039,10300
data_packet: 1011101010000000110101010101010000, 1373490828139,10400
data_packet: 1011101010000000110101010101010000, 1373490828239,10500
data_packet: 1011101010000000110101010101010000, 1373490828339,10600
data_packet: 1111101011111111110101010101010000, 1373490828439,10700
data_packet: 1111101011111111110101010101010000, 1373490828539,10800
data_packet: 1011101010000000110101010101010000, 1373490828639,10900
data_packet: 1011101010000000110101010101010000, 1373490828739,11000
data_packet: 1011101010000000110101010101010000, 1373490828839,11100
data_packet: 1011101010000000110101010101010000, 1373490828939,11200
data_packet: 1011101010000000110101010101010000, 1373490829039,11300
data_packet: 1011101010000000110101010101010000, 1373490829139,11400
data_packet: 1011101010000000110101010101010000, 1373490829239,11500
data_packet: 1011101010000000110101010101010000, 1373490829339,11600
data_packet: 1011101010000000110101010101010000, 1373490829439,11700
data_packet: 1011101010000000110101010101010000, 1373490829539,11800
data_packet: 1011101010000000110101010101010000, 1373490829639,11900
data_packet: 1011101010000000110101010101010000, 1373490829739,12000
data_packet: 1011101010000000110101010101010000, 1373490829839,12100
data_packet: 1011101010000000110101010101010000, 1373490829939,12200
data_packet: 1011101010000000110101010101010000, 1373490830039,12300
data_packet: 1011101010000000110101010101010000, 1373490830139,12400
data_packet: 1011101010000000110101010101010000, 1373490830239,12500
data_packet: 1011101010000000110101010101010000, 1373490830339,12600
data_packet: 1011101010000000110101010101010000, 1373490830439,12700
data_packet: 1011101010000000110101010101010000, 1373490830539,12800

The processor of the biomechanical parameter determination system (BPDS) sends two sets of outputs, for example, the current position and velocity information of the humans, and the activity patterns and falls to the cloud server. An example snippet of the position and velocity output of the processor of the BPDS is provided below.

{"spd_mean": 0.89, "event_timestamp": 1387922454404, "speed_variance": 0.46, "timestamp": 1392230497655, "speed_median": 0.5, "inactivity_timestamp": 1381912952700, "number_entry": 2, "speed_median": 0.5, "variance_y": 1.0, "variance_x": 2.96, "average_pos_x": 2.96, "average_pos_y": 1.0, "number_exit": 3, "number_fall": 0, "device_id": "b8-27-eb-4f-d4-69", "speed_max": 2.68}

{"spd_me": 0.0, "evt_ts": 1387925155304, "spd_vr": 0.0, "ts": 1392233206728, "spd_mi": 0.5, "ia_tm": 18446744069417744916, "n_ent": 0, "spd_md": 0.5, "var_y": 1.0, "var_x": 3.0, "avg_x": 3.0, "avg_y": 1.0, "n_ext": 0, "n_fll": 0, "id": "b8-27-eb-4f-d4-69", "spd_mx": 0.0}

{"spd_me": 0.0, "evt_ts": 1387902462139, "spd_vr": 0.0, "ts": 1392213610180, "spd_mi": 0.5, "ia_tm": 1381213610180, "n_ent": 0, "spd_md": 0.5, "var_y": 0.0, "var_x": 0.0, "avg_x": 0.0, "avg_y": 0.0, "n_ext": 0, "n_fll": 0, "id": "b8-27-eb-d8-72-35", "spd_mx": 0.0}

{"spd_me": 0.0, "evt_ts": 1387902462139, "spd_vr": 0.0, "ts": 1392213610171, "spd_mi": 0.5, "ia_tm": 1381213610180, "n_ent": 0, "spd_md": 0.5, "var_y": 0.0, "var_x": 0.0, "avg_x": 0.0, "avg_y": 0.0, "n_ext": 0, "n_fll": 0, "id": "b8-27-eb-d8-72-35", "spd_mx": 0.0}

{"spd_me": 0.0, "evt_ts": 1387902462139, "spd_vr": 0.0, "ts": 1392213610160, "spd_mi": 0.5, "ia_tm": 1381213610180, "n_ent": 0, "spd_md": 0.5, "var_y": 0.0, "var_x": 0.0, "avg_x": 0.0, "avg_y": 0.0, "n_ext": 0, "n_fll": 0, "id": "b8-27-eb-d8-72-35", "spd_mx": 0.0}

A snippet of the activity pattern and fall data is provided below.

TimeStamp(1)=1621500 positions=[5.0 5.0] velocity=[0.0 0.0] FallDetect=0 ActiveTime=1621500 InactiveTime=0
TimeStamp(2)=1622200 positions=[4.0 4.0] velocity=[0.0 0.0] FallDetect=0 ActiveTime=1622200 InactiveTime=0
TimeStamp(3)=1622300 positions=[4.2 4.2] velocity=[0.0 0.0] FallDetect=0 ActiveTime=1622300 InactiveTime=0
TimeStamp(4)=1622400 positions=[4.5 4.5] velocity=[0.0 0.0] FallDetect=0 ActiveTime=1622400 InactiveTime=0
TimeStamp(5)=1622500 positions=[4.5 4.5] velocity=[0.0 0.0] FallDetect=0 ActiveTime=1622500 InactiveTime=0
TimeStamp(6)=1622600 positions=[4.5 4.5] velocity=[0.0 0.0] FallDetect=0 ActiveTime=1622600 InactiveTime=0
TimeStamp(7)=1622700 positions=[4.3 4.3] velocity=[0.0 0.0] FallDetect=0 ActiveTime=1622700 InactiveTime=0
TimeStamp(8)=1622800 positions=[4.2 4.2] velocity=[0.0 0.0] FallDetect=0 ActiveTime=1622800 InactiveTime=0
TimeStamp(9)=1622900 positions=[4.0 4.0] velocity=[0.0 0.0] FallDetect=0 ActiveTime=1622900 InactiveTime=0
TimeStamp(10)=1623000 positions=[3.7 3.7] velocity=[0.0 0.0] FallDetect=0 ActiveTime=1623000 InactiveTime=0
TimeStamp(11)=1623100 positions=[3.2 3.2] velocity=[0.0 0.0] FallDetect=0 ActiveTime=1623100 InactiveTime=0
TimeStamp(12)=1623200 positions=[3.0 3.0] velocity=[0.0 0.0] FallDetect=0 ActiveTime=1623200 InactiveTime=0
TimeStamp(13)=1623500 positions=[2.0 2.0] velocity=[4.7 0.0] FallDetect=0 ActiveTime=1623500 InactiveTime=0
TimeStamp(14)=1623600 positions=[2.0 2.0] velocity=[5.1 0.0] FallDetect=0 ActiveTime=1623600 InactiveTime=0
TimeStamp(15)=1623800 positions=[1.3 1.3] velocity=[5.9 0.0] FallDetect=0 ActiveTime=1623800 InactiveTime=0

TimeStamp(16)=1623900 positions=[1.1 1.1] velocity=[5.9 0.0] FallDetect=0 ActiveTime=1623900 InactiveTime=0
TimeStamp(17)=1624000 positions=[0.9 0.9] velocity=[5.8 0.0] FallDetect=0 ActiveTime=1624000 InactiveTime=0
TimeStamp(18)=1624300 positions=[0.5 0.5] velocity=[5.0 0.0] FallDetect=0 ActiveTime=1624300 InactiveTime=0
TimeStamp(19)=1624400 positions=[0.5 0.5] velocity=[4.3 3.6] FallDetect=0 ActiveTime=1624400 InactiveTime=0
TimeStamp(20)=1624500 positions=[0.5 0.5] velocity=[2.8 4.1] FallDetect=0 ActiveTime=1624500 InactiveTime=0
TimeStamp(21)=1624700 positions=[0.6 0.6] velocity=[2.8 4.0] FallDetect=0 ActiveTime=1624700 InactiveTime=0
TimeStamp(22)=1624800 positions=[0.9 0.9] velocity=[2.0 3.5] FallDetect=0 ActiveTime=1624800 InactiveTime=0
TimeStamp(23)=1624900 positions=[0.8 0.8] velocity=[0.8 3.4] FallDetect=0 ActiveTime=1624900 InactiveTime=0
TimeStamp(24)=1625000 positions=[0.5 0.5] velocity=[0.8 3.3] FallDetect=0 ActiveTime=1625000 InactiveTime=0

The biomechanical parameter determination system (BPDS) summarizes and stores the data in cloud databases in a cloud computing environment and further processes the data to handle interactions with respondents, for example, caregivers, staff, family members, etc., in the cloud computing environment. In an embodiment, the BPDS transmits the output data of the processor to a BPDS application deployed on a cloud server in the cloud computing environment. The BPDS application summarizes and stores the data in cloud databases and processes the data to handle interactions with respondents. An example of the output of the BPDS in the cloud computing environment that handles the notifications, for example, falls or inactivity alerts is provided below.

| | | |
|---|---|---|
| 2013-11-20 23:45:30 | INACTIVITY | NOTIFY_STAFF |
| 2013-11-20 23:45:30 | INACTIVITY | active |
| 2013-11-21 00:37:38 | INACTIVITY | active |
| 2013-11-21 01:05:07 | INACTIVITY | active |
| 2013-11-21 01:10:59 | INACTIVITY | active |
| 2013-12-24 14:01:54 | INACTIVITY | active |
| 2014-01-04 22:13:21 | INACTIVITY | active |
| 2014-02-12 10:41:37 | INACTIVITY | active |
| 2014-02-20 00:32:52 | INACTIVITY | active |
| 2014-04-04 00:40:26 | INACTIVITY | active |
| 2014-06-02 23:32:58 | INACTIVITY | active |
| 2014-06-03 00:41:04 | INACTIVITY | active |
| 2014-06-03 01:10:51 | INACTIVITY | active |

Figure 2A:
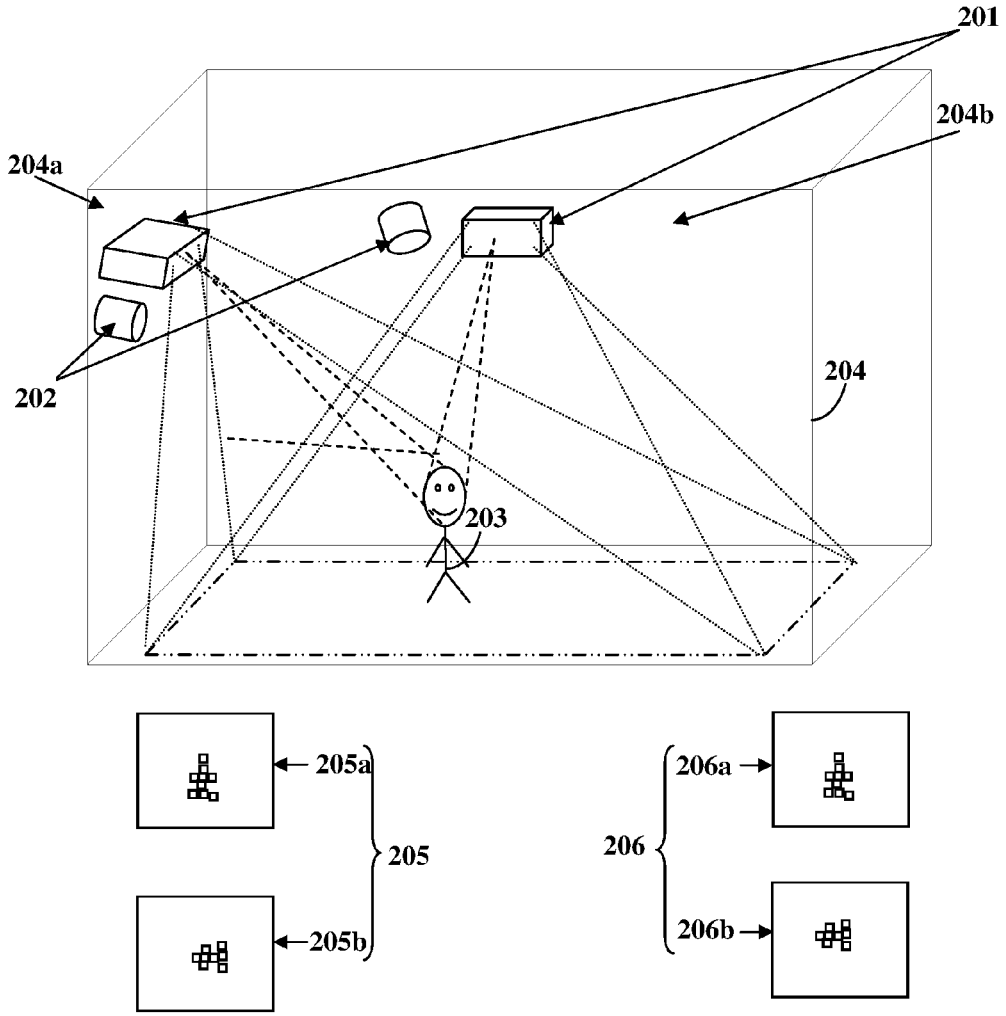
FIGS. 2A-2B exemplarily illustrate positioning of arrays of first sensors and second sensors in one or more spatial directions in a region for obtaining data of different types related to a target object.
Figure 2B:
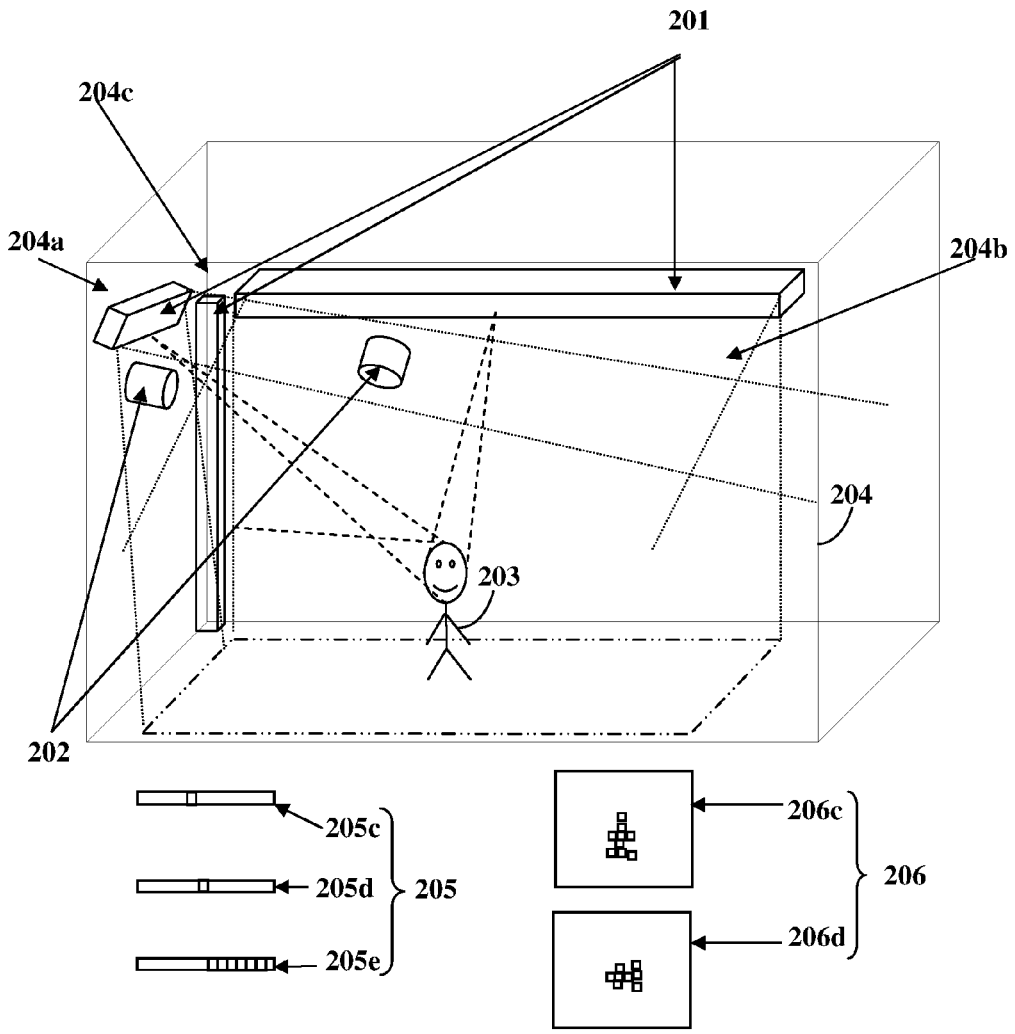

FIGS. 2A-2B exemplarily illustrate positioning of arrays of first sensors 201 and second sensors 202 in one or more spatial directions in a region 204 for obtaining data of different types related to a target object 203. Multiple first sensors 201 and second sensors 202 positioned in the form of a grid or an array provide reliable temperature estimates and can be used for detecting walking speed, fall, and posture of a target object 203. In an embodiment, the field of view of individual sensors 201 and/or 202 constituting the array is restricted in one or more planes to span a few degrees. In an embodiment, large fields of view of the arrays of first sensors 201 and second sensors 202 are designed by methods comprising, for example, sparse spatial distribution of the first sensors 201 and the second sensors 202, wide-angle planar Fresnel lenses with overlapping elements, densely spaced multi-dimensional arrays, etc. Multiple arrays of first sensors 201 are used to extend the field of view, improve spatial accuracy, avoid obstructions, and provide three-dimensional (3D) imaging. The arrays of first sensors 201 are used in conjunction with the second sensors 202 to improve detection and tracking. Positioning the first sensors 201 and the second sensors 202 in one or more spatial directions provides spatial and temporal location information of a target object 203 with a high accuracy and reliability. As exemplarily illustrated in FIG. 2A, two arrays of first sensors 201, for example, two-dimensional pyroelectric infrared sensors, and second sensors 202, for example, optical cameras or ultrasound sensors are positioned in different spatial directions in the region 204. The arrays of first sensors 201 positioned on opposing walls 204*a* and 204*b* of the region 204 in opposing spatial directions monitor the region 204 and generate first data 205 comprising temperature and/or motion data 205*a* and 205*b* of the target object 203 from their respective opposing spatial directions, while the second sensors 202 positioned on the opposing walls 204*a* and 204*b* of the region 204 in opposing spatial directions monitor the region 204 and generate second data 206 comprising optical images or ultrasound sensor data 206*a* and 206*b* of the target object 203 from their respective opposing spatial directions. The arrays of first sensors 201 and second sensors 202 transmit the generated first data 205 and the generated second data 206 to the biomechanical parameter determination system (BPDS) for processing, transformation, and determination of the biomechanical parameters of the target object 203 in the region 204.

As exemplarily illustrated in FIG. 2B, three arrays of first sensors 201, for example, one-dimensional pyroelectric infrared sensors, and two arrays of second sensors 202, for example, optical cameras or ultrasound sensors are positioned in different spatial directions in the region 204. The arrays of first sensors 201 positioned on the opposing walls 204*b* and 204*a* and the corner 204*c* of the region 204 in different spatial directions monitor the region 204 and generate first data 205 comprising temperature and/or motion data 205*c*, 205*d*, and 205*e* of the target object 203 from their respective opposing spatial directions, while the second sensors 202 positioned on the opposing walls 204*a* and 204*b* of the region 204 in opposing spatial directions monitor the region 204 and generate second data 206 comprising optical images or ultrasound sensor data 206*c* and 20*d* of the target object 203 from their respective opposing spatial directions. The arrays of first sensors 201 and second sensors 202 transmit the generated first data 205 and the generated second data 206 to the biomechanical parameter determination system (BPDS) for processing, transformation, and determination of the biomechanical parameters of the target object 203 in the region 204.

Figure 3:
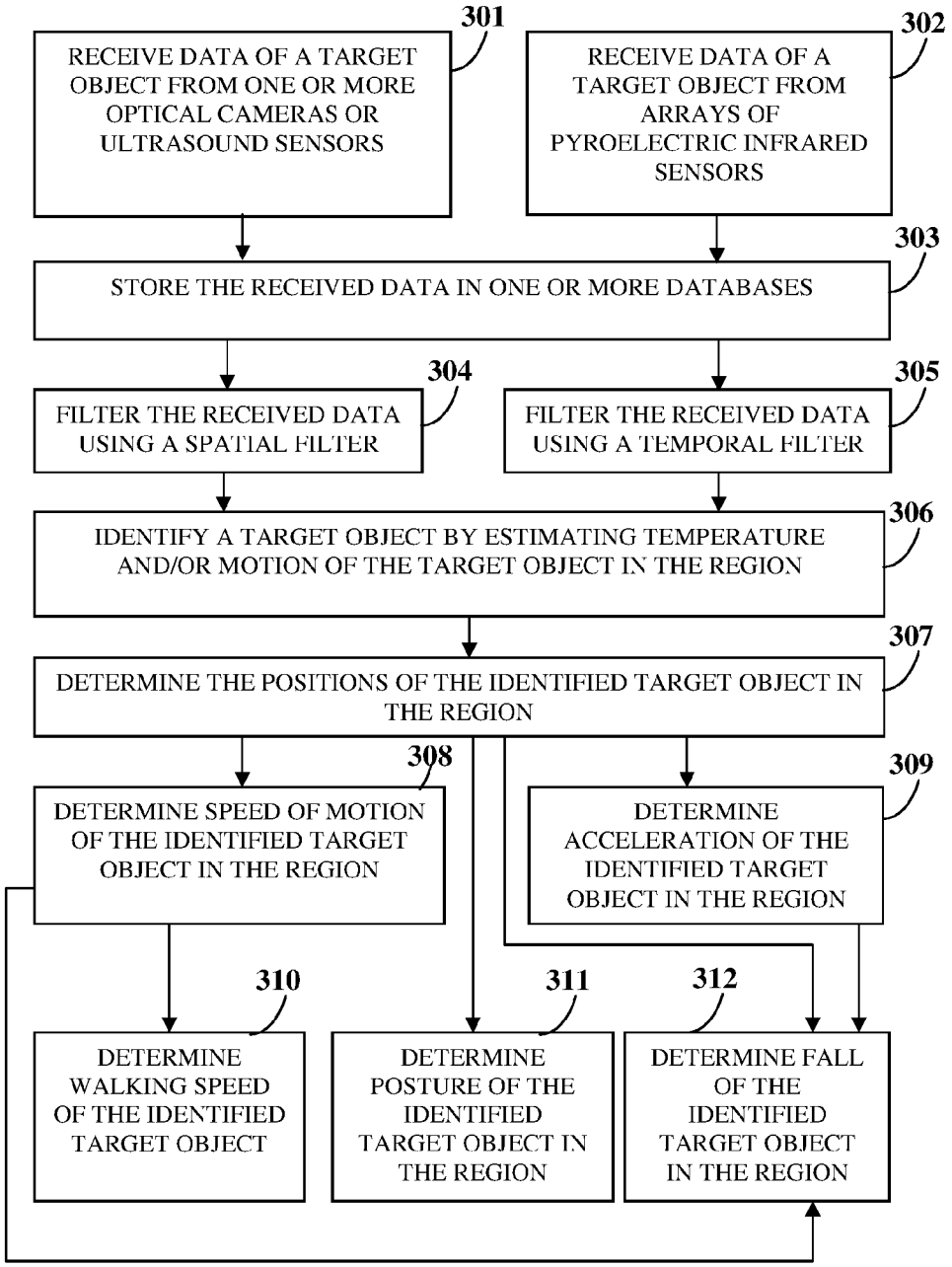
FIG. 3 exemplarily illustrates a flow diagram comprising steps performed by a biomechanical parameter determination system for determining biomechanical parameters of a target object in a region.

FIG. 3 exemplarily illustrates a flow diagram comprising steps performed by the biomechanical parameter determination system (BPDS) for determining biomechanical parameters of a target object in a region. The BPDS receives 301 data of a target object from one or more second sensors 202, for example, optical cameras or ultrasound sensors exemplarily illustrated in FIGS. 2A-2B. The BPDS also receives 302 data of the target object from arrays of first sensors 201, for example, pyroelectric infrared (PIR) sensors exemplarily illustrated in FIGS. 2A-2B. The BPDS stores 303 the received data in a memory unit, for example, in one or more databases. The BPDS filters 304 the received data using a spatial filter and also filters 305 the received data using a temporal filter. The BPDS identifies 306 a target object by estimating temperature and/or motion of the target object in the region using the data from the PIR sensors. The BPDS performs thresholding based on human temperature ranges, an estimate of the local temperature, and estimates of the local temperatures of the identified target objects. The BPDS determines 307 the positions of the identified target object in the region using the optical cameras or ultrasound sensors. The BPDS determines 308 the speed of motion of the identified target object in the region using the determined positions of the target object in the region. The BPDS determines 309 the acceleration of the identified target object in the region using the determined positions of the target object in the region. The BPDS determines 310 the walking speed of the identified target object using the determined speed of motion of the identified target object in the region. The BPDS determines 311 the posture of the identified target object in the region using the determined positions of the identified target object in the region. The BPDS determines 312 the fall of the identified target object in the region using the determined positions, the determined speed of motion, and the determined acceleration of the identified target object in the region. In an embodiment, the biomechanical parameter determination system (BPDS) determines fall and posture using the determined positions of the identified target object only and without the speed of motion, acceleration, and walking speed. In an embodiment, the BPDS applies area or volume based processing to the temperature, position, walking speed or fall data.

Figure 4:
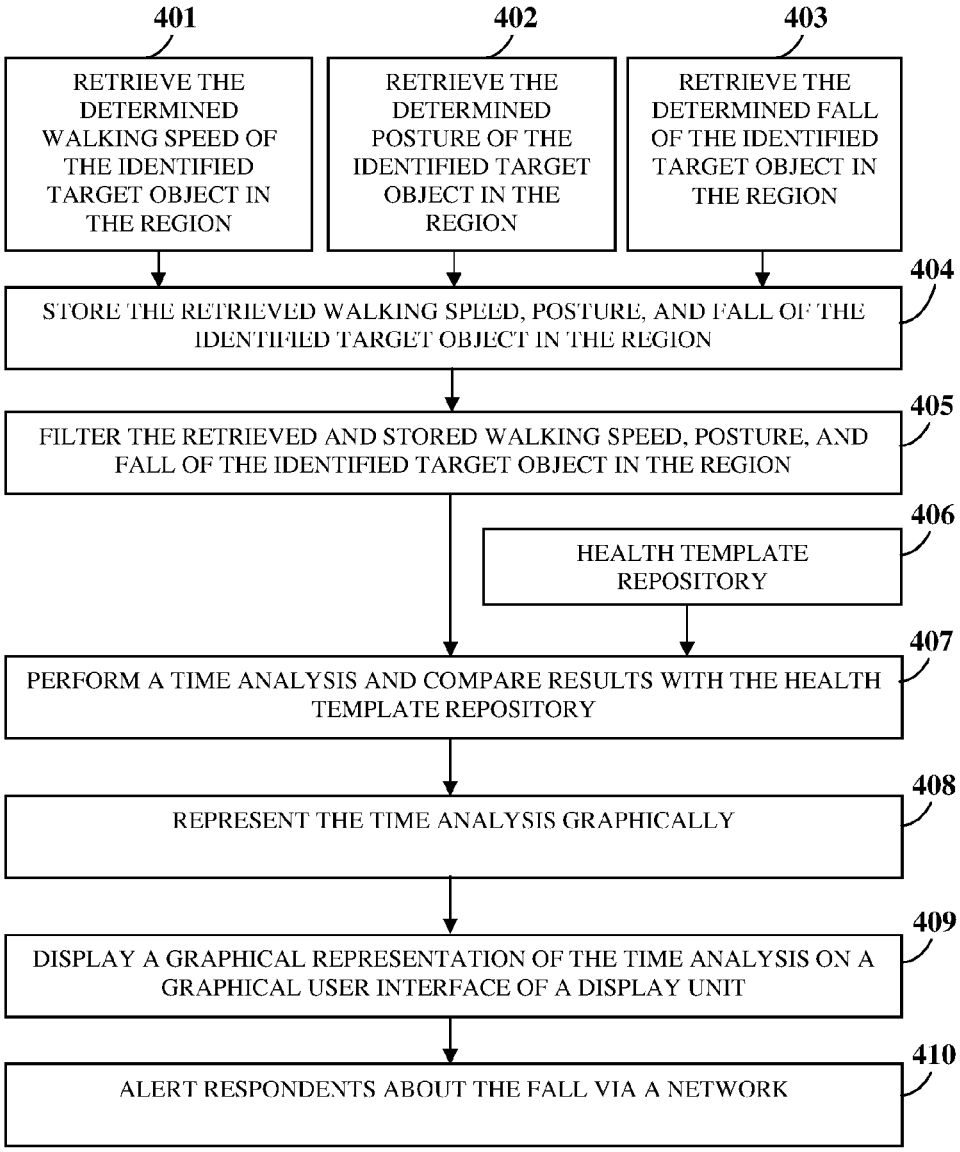
FIG. 4 exemplarily illustrates a flow diagram comprising steps performed by the biomechanical parameter determination system for assessing health of a target object in a region and determining a fall risk of the target object in the region.

FIG. 4 exemplarily illustrates a flow diagram comprising steps performed by the biomechanical parameter determination system (BPDS) for assessing health of a target object in a region and determining a fall risk of the target object in the region. The BPDS retrieves 401 the determined walking speed of the identified target object in the region as input for further processing. The BPDS retrieves 402 the determined posture of the identified target object in the region as input for further processing. The BPDS retrieves 403 the determined fall of the identified target object in the region as input for further processing. In an embodiment, the BPDS performs steps 401, 402, and 403 during real time imaging of the target object, for example, when the target object moves in the region. The BPDS stores 404 the retrieved walking speed, posture, and fall of the identified target object in the region. The BPDS filters 405 the retrieved and stored walking speed, posture, and fall of the identified target object in the region. The BPDS performs 407 a time analysis of the filtered walking speed, posture, and fall of the identified target object in the region and compares the results of the time analysis with the health template repository 406 as disclosed in the detailed description of FIGS. 1A-1B, to assess health of the identified target object in the region and determine a fall risk of the identified target object. The BPDS represents 408 the results of the time analysis graphically. The BPDS displays 409 a graphical representation of the time analysis on a graphical user interface of a display unit. The BPDS alerts 410 respondents about the fall via a network.

Figure 5:
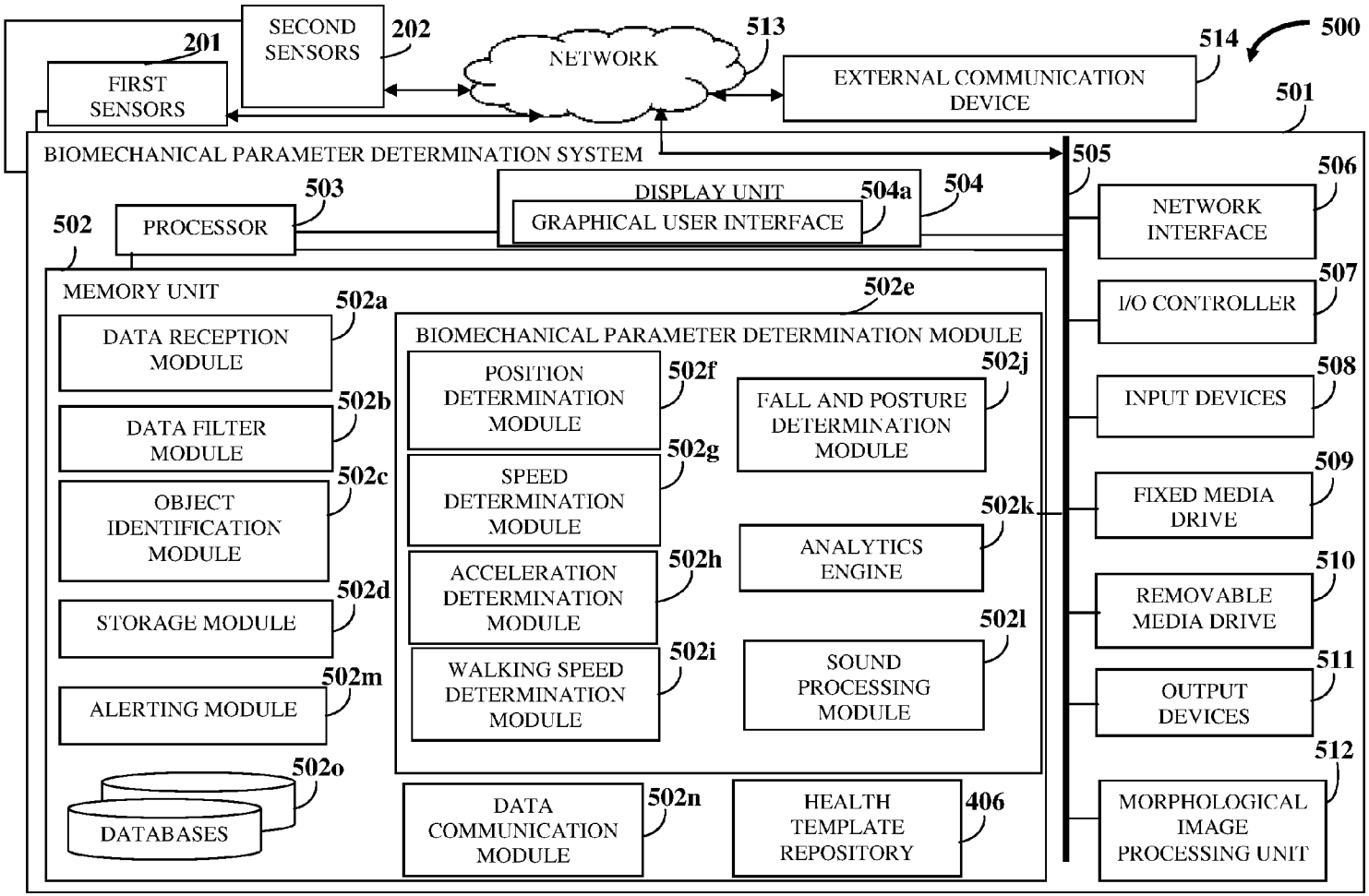
FIG. 5 exemplarily illustrates a system for determining biomechanical parameters of one or more target objects in a region.

FIG. 5 exemplarily illustrates a system 500 for determining biomechanical parameters of one or more target objects in a region. The system 500 disclosed herein comprises the biomechanical parameter determination system (BPDS) 501 operably coupled to first sensors 201, for example, pyroelectric infrared (PIR) sensors, and to second sensors 202, for example, audio sensors, optical cameras or ultrasound sensors via a network 513. In the system 500 disclosed herein, the first sensors 201 and the second sensors 202 are positioned in different spatial directions in a region. The first sensors 201 detects temperature and/or motion of the target objects in the region. The second sensors 202 capture optical images, detect sound, and determine amplitude and distance of the target objects in the region. The first sensors 201 comprise, for example, one-dimensional PR sensors and two-dimensional PR sensors. The second sensors 202 comprise, for example, one-dimensional optical sensors, two-dimensional optical sensors, one-dimensional ultrasound sensors, two-dimensional ultrasound sensors, and audio sensors.

The network 513 is, for example, one of the internet, an intranet, a wired network, a wireless network, a communication network that implements Bluetooth® of Bluetooth Sig, Inc., a network that implements Wi-Fi® of Wi-Fi Alliance Corporation, an ultra-wideband communication network (UWB), a wireless universal serial bus (USB) communication network, a communication network that implements ZigBee® of ZigBee Alliance Corporation, a general packet radio service (GPRS) network, a mobile telecommunication network such as a global system for mobile (GSM) communications network, a code division multiple access (CDMA) network, a third generation (3G) mobile communication network, a fourth generation (4G) mobile communication network, a fifth generation (5G) mobile communication network, a long-term evolution (LTE) mobile communication network, a public telephone network, etc., a local area network, a wide area network, an internet connection network, an infrared communication network, etc., or a network formed from any combination of these networks. In an embodiment, the biomechanical parameter determination system (BPDS) 501 is accessible to respondents, for example, through a broad spectrum of technologies and devices such as cellular phones, tablet computing devices, etc., with access to the internet.

As exemplarily illustrated in FIG. 5, the biomechanical parameter determination system (BPDS) 501 comprises a non-transitory computer readable storage medium, for example, a memory unit 502 for storing programs and data, and at least one processor 503 communicatively coupled to the non-transitory computer readable storage medium and operably coupled to the first sensors 201 and the second sensors 202. As used herein, "non-transitory computer readable storage medium" refers to all computer readable media, for example, non-volatile media, volatile media, and transmission media, except for a transitory, propagating signal. Non-volatile media comprise, for example, solid state drives, optical discs or magnetic disks, and other persistent memory volatile media including a dynamic random access memory (DRAM), which typically constitutes a main memory. Volatile media comprise, for example, a register memory, a processor cache, a random access memory (RAM), etc. Transmission media comprise, for example, coaxial cables, copper wire, fiber optic cables, modems, etc., including wires that constitute a system bus coupled to the processor 503, etc. The non-transitory computer readable storage medium stores computer program instructions defined by modules, for example, 502*a*, 502*b*, 502*c*, 502*d*, 502*e*, 502*f*, 502*g*, 502*h*, 502*i*, 502*j*, 502*k*, 502*l*, 502*m*, 502*n*, etc., of the BPDS 501. The BPDS 501 is installed and stored in the memory unit 502 of the BPDS 501. The memory unit 502 is used for storing program instructions, applications, and data. The memory unit 502 is, for example, a random access memory (RAM) or another type of dynamic storage device that stores information and instructions for execution by the processor 503. The memory unit 502 also stores temporary variables and other intermediate information used during execution of the instructions by the processor 503. The BPDS 501 further comprises a read only memory (ROM) or another type of static storage device that stores static information and instructions for the processor 503.

The processor 503 executes the computer program instructions defined by the modules, for example, 502*a*, 502*b*, 502*c*, 502*d*, 502*e*, 502*f*, 502*g*, 502*h*, 502*i*, 502*j*, 502*k*, 502*l*, 502*m*, 502*n*, etc., of the biomechanical parameter determination system (BPDS) 501. The processor 503 refers to any one or more microprocessors, central processing unit (CPU) devices, finite state machines, computers, microcontrollers, digital signal processors, logic, a logic device, an user circuit, an application specific integrated circuit (ASIC), a field-programmable gate array (FPGA), a chip, a digital circuit, an analog circuit, etc., or any combination thereof, capable of executing computer programs or a series of commands, instructions, or state transitions. In an embodiment, the processor 503 is implemented as a processor set comprising, for example, a programmed microprocessor and a math or graphics co-processor. The processor 503 is selected, for example, from the Intel® processors such as the Itanium® microprocessor or the Pentium® processors, Advanced Micro Devices (AMD®) processors such as the Athlon® processor, UltraSPARC® processors, microSPARC® processors, hp® processors, International Business Machines (IBM®) processors such as the PowerPC® microprocessor, the MIPS® reduced instruction set computer (RISC) processor of MIPS Technologies, Inc., RISC based computer processors of ARM Holdings, Motorola® processors, Qualcomm® processors, etc. The BPDS 501 disclosed herein is not limited to employing a processor 503. In an embodiment, the BPDS 501 employs a controller or a microcontroller. The processor 503 executes the modules, for example, 502*a*, 502*b*, 502*c*, 502*d*, 502*e*, 502*f*, 502*g*, 502*h*, 502*i*, 502*j*, 502*k*, 502*l*, 502*m*, 502*n*, etc., of the BPDS 501. In an embodiment, the BPDS 501 is implemented on a small companion board with a processor 503 that directly interfaces with the first sensors 201 and the second sensors 202 and processes information before sending the processed information out of the region of operation to another network, for example, a cloud server. The amount of processing on the cloud server versus the local processor 503 is flexible. In an embodiment, the processor 503 is miniaturized and integrated with the first sensors 201 and the second sensors 202.

The biomechanical parameter determination system (BPDS) 501 comprises a data reception module 502*a*, a data filter module 502*b*, an object identification module 502*c*, a storage module 502*d*, a biomechanical parameter determination module 502*e*, an alerting module 502*m*, a data communication module 502*n*, one or more databases 502*o*, and the health template repository 406 stored, in an embodiment, in the memory unit 502. The data reception module 502*a* dynamically receives first data comprising the temperature data and/or the motion data of target objects in the region from one or more of the first sensors 201 over the network 513. The data reception module 502*a* also dynamically receives second data comprising the optical images, and/or sound data, and/or the amplitude and/or the distance of the target objects in the region from the second sensors 202 over the network 513. The storage module 502*d* stores the dynamically received first data and the dynamically received second data of the target objects in one or more databases 502*o*. The databases 502*o* of the BPDS 501 refer to any storage area or medium that can be used for storing data and files. In an embodiment, the databases 502*o* can be, for example, any of a structured query language (SQL) data store or a not only SQL (NoSQL) data store such as the Microsoft® SQL Server®, the Oracle® servers, the MySQL® database of MySQL AB Limited Company, the mongoDB® of MongoDB, Inc., the Neo4j graph database of Neo Technology Corporation, the Cassandra database of the Apache Software Foundation, the HBase® database of the Apache Software Foundation, etc. In another embodiment, the databases 502*o* can also be a location on a file system. In another embodiment, the databases 502*o* can be remotely accessed by the BPDS 501 via the network 513. In another embodiment, the databases 502*o* are configured as cloud based databases implemented in a cloud computing environment, where computing resources are delivered as a service over the network 513. In an embodiment, the BPDS 501 is a cloud computing based platform implemented as a service for determining one or more biomechanical parameters of one or more target objects in a region.

The data filter module 502*b* filters the dynamically received first data and the dynamically received second data of the target objects. The data filter module 502*b* spatially filters the dynamically received first data and the dynamically received second data of the target objects using a spatial filter or temporally filters the dynamically received first data and the dynamically received second data of the target objects using a temporal filter. In an embodiment, the biomechanical parameter determination system 501 further comprises a morphological image processing unit 512 operably coupled to the spatial filter or the temporal filter and performs morphological image processing on the dynamically received first data and the dynamically received second data of the target objects. The object identification module 502*c* identifies one or more target objects in the region using the temperature data and/or the motion data of the target objects in the region extracted from the filtered first data. In an embodiment, the object identification module 502*c* identifies the target objects in the region by estimating the temperature and/or the motion of the target objects in the region based on a predetermined temperature threshold range and/or a predetermined motion threshold range respectively.

The biomechanical parameter determination module 502*e* determines one or more of multiple biomechanical parameters associated with each of the identified target objects in the region using the filtered first data and/or the filtered second data for emergency alerting and/or health assessment as disclosed in the detailed description of FIGS. 1A-1B. In an embodiment, the biomechanical parameter determination module 502*e* comprises a position determination module 502*f*, a speed determination module 502*g*, an acceleration determination module 502*h*, a walking speed determination module 502*i*, and a fall and posture determination module 502*j*. The position determination module 502*f* determines positions of the identified target objects in the region and tracks the determined positions of the identified target objects as a function of time to generate position-time values. The speed determination module 502*g* determines speed of motion of each of the identified target objects extracted from the filtered first data and/or the filtered second data, using the generated position-time values. In an embodiment, the speed determination module 502*g* determines the speed of motion of each of the identified target objects by curve-fitting the generated position-time values. The acceleration determination module 502*h* determines acceleration of each of the identified target objects using the generated position-time values or the determined speed of motion of each of the identified target objects. In an embodiment, the acceleration determination module 502*h* determines acceleration of each of the identified target objects by curve-fitting of velocity-time values or location-time values. The walking speed determination module 502*i* determines walking speed of each of the identified target objects using the determined speed of motion of each of the identified target objects based on walking criteria comprising, for example, a falling condition, a running condition, a normal walking condition, and a intent based walking condition.

The fall and posture determination module 502*j* determines fall and posture of each of the identified target objects using one or more of the determined speed of motion of each of the identified target objects, the determined acceleration of each of the identified target objects, and change in the determined positions of the identified target objects followed by a predetermined time period of inactivity by each of the identified target objects, to alert a respondent.

The storage module 502*d* stores the determined positions, the determined speed of motion, the determined acceleration, the determined walking speed, and the determined fall and posture of the identified target objects in one or more databases 502*o*. In an embodiment, the storage module 502*d* records a time of occurrence of the determined fall of each of the identified target objects, a location of occurrence of the determined fall, a speed of the determined fall, an acceleration associated with the determined fall, and a pattern of the determined fall in one or more databases 502*o*. In another embodiment, the fall and posture determination module 502*j* determines a severity level of the determined fall of each of the identified target objects by comparing a pattern of the determined fall with predetermined template patterns of falls stored in one or more databases 502*o*.

In an embodiment, the biomechanical parameter determination module 502*e* further comprises a sound processing module 502*l* for splitting the sound data extracted from the filtered second data into sound snippets. The analytics engine 502*k* analyzes the sound snippets independently or in conjunction with the first data and/or another of the second data along with preconfigured sound templates for the determination of the biomechanical parameters associated with each of the identified target objects in the region. In an embodiment, the sound processing module 502*l* renders question prompts to the target objects in the region and interprets a response or a non-response to the question prompts to confirm a fall of each of the identified target objects in the region. In this embodiment, the alerting module 502*m* alerts one or more respondents based on the interpretation via the network 513.

In an embodiment, the analytics engine 502*k* assesses health of each of the identified target objects in communication with the health template repository 406 using the determined walking speed and the determined fall and posture of the identified target objects in the region. The health template repository 406 stores, for example, data of walking speed, fall and posture, medical conditions, diseases such as Alzheimer's, dementia, etc., symptoms of diseases, etc. The analytics engine 502*k* further determines a fall risk of each of the identified target objects by performing a time analysis of the determined walking speed and/or the determined posture of each of the identified target objects. The alerting module 502*m* generates alerts that indicate an occurrence of a fall, and/or a health status, and/or a fall risk using the determined biomechanical parameters and transmits the generated alerts to respondents via the network 513. The data communication module 502*n* communicates with an external communication device 514 over the network 513 to receive input from the external communication device 514 and transmit output data to the external communication device 514. The external communication device 514 is, for example, one of a general wireless Ethernet device, a wired Ethernet device, a wireless local area network (LAN) device, a wired LAN device, a serial data port, a parallel data port, a visual or auditory or textual alarm system, or other device for communicating the determined biomechanical parameters to an external device or to user. In an embodiment, the data communication module 502*n* communicates the determined biomechanical parameters to the external communication device 514, for example, an alarm device or a computer readable storage medium, or a centralized server.

As exemplarily illustrated in FIG. 5, the biomechanical parameter determination system (BPDS) 501 further comprises a display unit 504, a data bus 505, a network interface 506, an input/output (I/O) controller 507, input devices 508, a fixed media drive 509 such as a hard drive, a removable media drive 510 for receiving removable media, output devices 511, etc. The data bus 505 permits communications between the modules, for example, 502, 503, 504, 506, 507, 508, 509, 510, 511, 512, etc., of the BPDS 501. The network interface 506 enables connection of the BPDS 501 to the network 513. In an embodiment, the network interface 506 is provided as an interface card also referred to as a line card. The network interface 506 comprises, for example, one or more of an infrared (IR) interface, an interface implementing Wi-Fi® of Wi-Fi Alliance Corporation, a universal serial bus (USB) interface, a FireWire® interface of Apple Inc., an Ethernet interface, a frame relay interface, a cable interface, a digital subscriber line (DSL) interface, a token ring interface, a peripheral controller interconnect (PCI) interface, a local area network (LAN) interface, a wide area network (WAN) interface, interfaces using serial protocols, interfaces using parallel protocols, Ethernet communication interfaces, asynchronous transfer mode (ATM) interfaces, a high speed serial interface (HSSI), a fiber distributed data interface (FDDI), interfaces based on transmission control protocol (TCP)/internet protocol (IP), interfaces based on wireless communications technology such as satellite technology, radio frequency (RF) technology, near field communication, etc. The I/O controller 507 controls input actions and output actions performed by the BPDS 501.

The display unit 504, via a graphical user interface (GUI) 504*a*, displays the output of the time analysis. The display unit 504 comprises, for example, a video display, a liquid crystal display, a plasma display, an organic light emitting diode (OLED) based display, etc. The GUI 504*a* is a graphing module, for example, a webpage or a sophisticated display engine such as a Java-D3 interface that dynamically displays the data based on a user's preference. The input devices 508 are used for inputting data into the biomechanical parameter determination system (BPDS) 501. The input devices 508 are, for example, a keyboard such as an alphanumeric keyboard, a microphone, a joystick, a pointing device such as a computer mouse, a touch pad, a light pen, a physical button, a touch sensitive display device, a track ball, a pointing stick, any device capable of sensing a tactile input, etc. The user uses the input devices 508 to provide inputs to the BPDS 501. For example, a user accesses the health status, fall risk data, etc., by clicking the GUI 504*a* using the input devices 508.

Computer applications and programs are used for operating the biomechanical parameter determination system (BPDS) 501. The programs are loaded onto the fixed media drive 509 and into the memory unit 502 of the system 500 via the removable media drive 510. In an embodiment, the computer applications and programs are loaded directly into the BPDS 501 via the network 513. The output devices 511, for example, a display monitor, a webpage, a phone, or other display devices output the results of operations performed by the BPDS 501, for example, in a format of texts, graphs or other user formats. For example, the BPDS 501 renders the health status, fall risk data, time analysis data, etc., to users using the output devices 511.

The processor 503 executes an operating system selected, for example, from the Linux® operating system, the Unix® operating system, any version of the Microsoft® Windows® operating system, the Mac OS of Apple Inc., the IBM® OS/2, VxWorks® of Wind River Systems, Inc., QNX Neutrino® developed by QNX Software Systems Ltd., the Palm OS®, the Solaris operating system developed by Sun Microsystems, Inc., the Android® operating system of Google Inc., the Windows Phone® operating system of Microsoft Corporation, the BlackBerry® operating system of BlackBerry Limited, the iOS operating system of Apple Inc., the Symbian™ operating system of Symbian Foundation Limited, etc. The biomechanical parameter determination system (BPDS) 501 employs the operating system for performing multiple tasks. The operating system is responsible for management and coordination of activities and sharing of resources of the BPDS 501. The operating system further manages security of the BPDS 501, peripheral devices connected to the BPDS 501, and network connections. The operating system employed by the BPDS 501 recognizes, for example, inputs provided by the user of the BPDS 501 using one of the input devices 508, the output devices 511, and files and directories stored locally in the fixed media drive 509. The operating system of the BPDS 501 executes different programs using the processor 503. The processor 503 and the operating system together define a computer platform for which application programs in high level programming languages are written. The operating system of the BPDS 501 determines the programming languages used in the BPDS 501. For example, the Java® programming language is used for developing the BPDS 501 with an Android® operating system, while Objective-C® of Apple Inc., is used for developing the BPDS 501 with the iOS operating system, and the UNITY® libraries and platforms of Unity IPR ApS, LLC., are used for developing the BPDS 501 with both the Android® operating system and the iOS operating system.

The processor 503 retrieves instructions defined by the data reception module 502*a*, the data filter module 502*b*, the object identification module 502*c*, and the biomechanical parameter determination module 502*e* comprising the position determination module 502*f*, the speed determination module 502*g*, the acceleration determination module 502*h*, the walking speed determination module 502*i*, the fall and posture determination module 502*j*. the analytics engine 502*k*, and the sound processing module 502*l* for performing respective functions disclosed above. The processor 503 further retrieves instructions defined by the alerting module 502*m*, the storage module 502*d*, and the data communication module 502*n* for performing respective functions disclosed above. The processor 503 retrieves instructions for executing the modules, for example, 502*a*, 502*b*, 502*c*, 502*d*, 502*e*, 502*f*, 502*g*, 502*h*, 502*i*, 502*j*, 502*k*, 502*l*, 502*m*, 502*n*, etc., of the biomechanical parameter determination system (BPDS) 501 from the memory unit 502. A program counter determines the location of the instructions in the memory unit 502. The program counter stores a number that identifies the current position in the program of each of the modules, for example, 502*a*, 502*b*, 502*c*, 502*d*, 502*e*, 502*f*, 502*g*, 502*h*, 502*i*, 502*j*, 502*k*, 502*l*, 502*m*, 502*n*, etc., of the BPDS 501. The instructions fetched by the processor 503 from the memory unit 502 after being processed are decoded. The instructions are stored in an instruction register in the processor 503. After processing and decoding, the processor 503 executes the instructions, thereby performing processes defined by those instructions.

At the time of execution, the instructions stored in the instruction register are examined to determine the operations to be performed. The processor 503 then performs the specified operations. The operations comprise arithmetic operations and logic operations. The operating system performs multiple routines for performing a number of tasks required to assign the input devices 508, the output devices 511, and the memory unit 502 for execution of the modules, for example, 502*a*, 502*b*, 502*c*, 502*d*, 502*e*, 502*f*, 502*g*, 502*h*, 502*i*, 502*j*, 502*k*, 502*l*, 502*m*, 502*n*, etc., of the biomechanical parameter determination system (BPDS) 501. The tasks performed by the operating system comprise, for example, assigning memory to the modules, for example, 502*a*, 502*b*, 502*c*, 502*d*, 502*e*, 502*f*, 502*g*, 502*h*, 502*i*, 502*j*, 502*k*, 502*l*, 502*m*, 502*n*, etc., of the BPDS 501, and to data used by the BPDS 501, moving data between the memory unit 502 and disk units, and handling input/output operations. The operating system performs the tasks on request by the operations and after performing the tasks, the operating system transfers the execution control back to the processor 503. The processor 503 continues the execution to obtain outputs. The outputs of the execution of the modules, for example, 502*a*, 502*b*, 502*c*, 502*d*, 502*e*, 502*f*, 502*g*, 502*h*, 502*i*, 502*j*, 502*k*, 502*l*, 502*m*, 502*n*, etc., of the BPDS 501 are displayed to the user on the output devices 511.

For purposes of illustration, the detailed description refers to the biomechanical parameter determination system (BPDS) 501 being run locally as a single computer system; however the scope of the method and system 500 disclosed herein is not limited to the BPDS 501 being run locally on a single computer system via the operating system and the processor 503, but may be extended to run remotely over the network 513 by employing a web browser and a remote server, a mobile phone, or other electronic devices. In an embodiment, one or more portions of the BPDS 501 are distributed across one or more computer systems (not shown) coupled to the network 513.

Disclosed herein is also a non-transitory computer readable storage medium that stores computer program codes comprising instructions executable by at least one processor 503 for determining biomechanical parameters of one or more target objects in a region. The computer program codes comprise a first computer program code for dynamically receiving first data comprising temperature data and/or motion data of the target objects in the region from one or more first sensors 201 positioned in one or more spatial directions in the region over the network 513; a second computer program code for dynamically receiving second data comprising optical images, and/or sound data, and/or amplitude and distance of the target objects in the region from one or more second sensors 202 positioned in one or more spatial directions in the region over the network 513; a third computer program code for filtering the dynamically received first data and the dynamically received second data of the target objects; a fourth computer program code for identifying one or more target objects in the region using the temperature data and/or the motion data of the target objects in the region extracted from the filtered first data; and a fifth computer program code for determining one or more of multiple biomechanical parameters associated with each of the identified target objects in the region using the filtered first data and/or the filtered second data for emergency alerting and/or health assessment.

In an embodiment, the fifth computer program code for determining one or more of multiple biomechanical parameters associated with each of the identified target objects in the region comprises a sixth computer program code for determining positions of the identified target objects in the region and tracking the determined positions of the identified target objects as a function of time to generate position-time values; a seventh computer program code for determining speed of motion of each of the identified target objects extracted from the filtered first data and/or the filtered second data, using the generated position-time values; an eighth computer program code for determining acceleration of each of the identified target objects using the generated position-time values and/or the determined speed of motion of each of the identified target objects; a ninth computer program code for determining walking speed of each of the identified target objects using the determined speed of motion of each of the identified target objects based on the walking criteria; and a tenth computer program code for determining fall and posture of each of the identified target objects using the determined speed of motion of each of the identified target objects, and/or the determined acceleration of each of the identified target objects, and/or change in the determined positions of the identified target objects followed by a predetermined time period of inactivity by each of the identified target objects, to alert a respondent.

In an embodiment, the fifth computer program code further comprises an eleventh computer program code for splitting the sound data extracted from the filtered second data into sound snippets; and a twelfth computer program code for analyzing the sound snippets independently or in conjunction with the first data and/or another of the second data along with preconfigured sound templates for the determination of the biomechanical parameters associated with each of the identified target objects in the region. In another embodiment, the computer program codes further comprises a thirteenth computer program code for rendering question prompts to the target objects in the region; a fourteenth computer program code for interpreting a response or a non-response to the question prompts to confirm a fall of each of the identified target objects in the region, and a fifteenth computer program code for alerting one or more respondents based on the interpretation via the network 513.

In an embodiment, the computer program codes further comprise a sixteenth computer program code for assessing health of each of the identified target objects in communication with the health template repository 406 using the determined biomechanical parameters comprising a walking speed, a fall, and a posture associated with each of the identified target objects in the region. In an embodiment, the sixteenth computer program code comprises a seventeenth computer program code for determining a fall risk of each of the identified target objects by performing a time analysis of the walking speed and/or the posture of each of the identified target objects. In another embodiment, the computer program codes further comprise an eighteenth computer program code for generating alerts that indicate one or more of an occurrence of a fall, a health status, and a fall risk using the determined biomechanical parameters and transmitting the generated alerts to one or more respondents via the network 513.

The non-transitory computer readable storage medium disclosed herein further stores additional computer program codes for performing additional steps that may be required and contemplated for determining biomechanical parameters of one or more target objects in a region. In an embodiment, a single piece of computer program code comprising computer executable instructions performs steps of the method disclosed herein for determining biomechanical parameters of one or more target objects in a region. The computer program codes comprising computer executable instructions are embodied on the non-transitory computer readable storage medium. The processor 503 of the biomechanical parameter determination system 501 retrieves these computer executable instructions and executes them. When the computer executable instructions are executed by the processor 503, the computer executable instructions cause the processor 503 to perform the steps of the method for determining biomechanical parameters of one or more target objects in a region.

The functions, acts, or tasks disclosed in the detailed description of FIGS. 1A-5, are executed in response to one or more sets of computer executable instructions stored in or on the non-transitory computer readable storage medium. These functions, acts, or tasks are independent of a particular type of instructions set, storage media, processor 503, or processing functions and may be performed by software, hardware, integrated circuits, firmware, micro code, etc., operating alone or in combination with each other. The processing functions comprise, for example, multiprocessing, multitasking, parallel processing, sequence division processing, etc. In an embodiment, the computer readable instructions are stored on a removable media device for reading by local or remote systems. In other embodiments, the computer readable instructions are stored in a remote location for transfer through a computer network or over telephone lines. In other embodiments, the computer readable instructions are stored within a particular computer, a central processing unit (CPU), or a graphics processing unit (GPU) or system.

Figure 6:
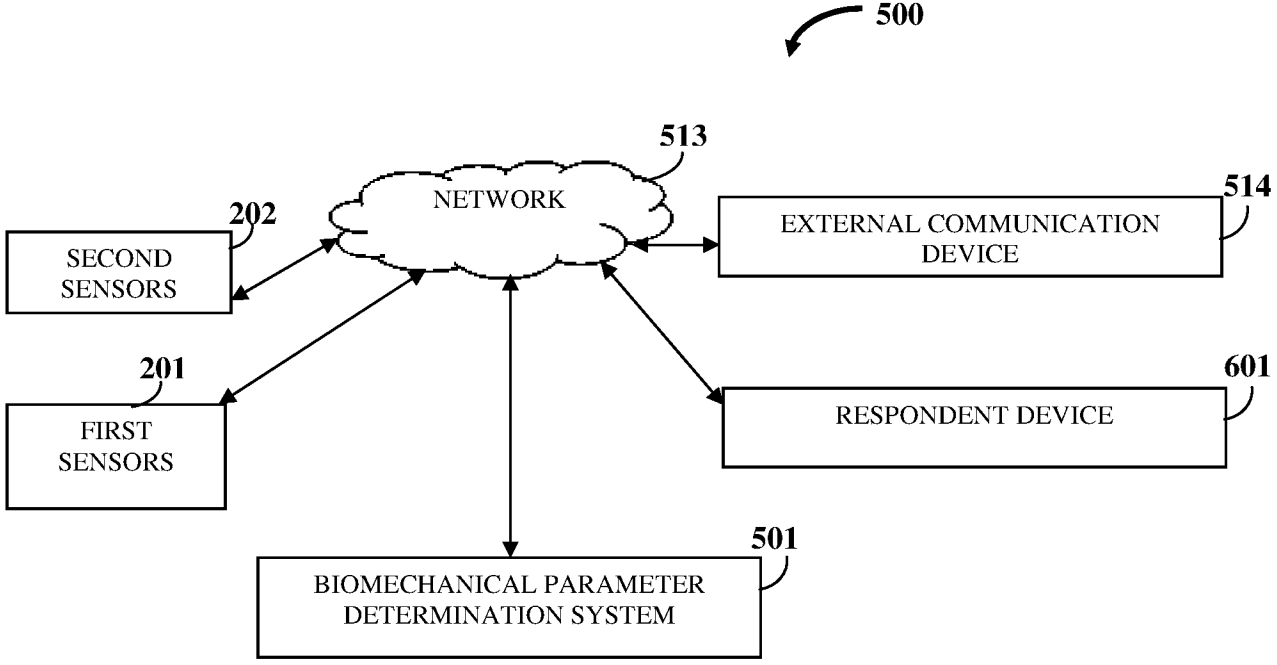
FIG. 6 exemplarily illustrates communication between multiple components of the system for determining biomechanical parameters of one or more target objects in a region.

FIG. 6 exemplarily illustrates communication between multiple components of the system 500 for determining biomechanical parameters of one or more target objects in a region. In an embodiment, the biomechanical parameter determination system (BPDS) 501 of the system 500 disclosed herein communicates with the first sensors 201 and the second sensors 202, the external communication device 514, and a respondent device 601 via the network 513. The respondent device 601 is an electronic device, for example, one of a personal computer, a tablet computing device, a mobile computer, a mobile phone, a smart phone, a portable computing device, a laptop, a personal digital assistant, a wearable device such as the Google Glass™ of Google Inc., the Apple Watch® of Apple Inc., etc., a touch centric device, a workstation, a server, a client device, a portable electronic device, a network enabled computing device, an interactive network enabled communication device, a web browser, any other suitable computing equipment, combinations of multiple pieces of computing equipment, etc. The BPDS 501 transmits an alert to the respondent device 601 via the network 513 to notify the respondent device 601 with information regarding a fall, a fall risk, and/or a health status of one or more target objects in the region, determined by the BPDS 501. The BPDS 501 transmits an alert to the respondent device 601, for example, as an audible alarm, a visible alarm, a readable text, etc.

In an embodiment, the biomechanical parameter determination system (BPDS) 501 communicates with the external communication device 514 to obtain sensor data measured by the sensors 201 and 202 and stored in the external communication device 514 via the network 513 for determining biomechanical parameters of one or more target objects in a region and for notifying the respondent device 601. A generic computer using a generic program cannot interface instantaneously with the sensors 201 and 202 located in the region of interest where the biomechanical parameters, for example, the fall, the posture, the walking speed, the positions, etc., of the target objects are to be determined and monitored. In the system 500 disclosed herein, the BPDS 501 interfaces with the sensors 201 and 202, the external communication device 514, and the respondent device 601 for determining biomechanical parameters of one or more target objects in a region, and therefore uses more than one computing system. The data, for example, temperature, motion, optical images, sound data, etc., of the target objects received from the sensors 201 and 202 via the network 513 are processed and executed by an algorithm in the BPDS 501 for storing, determining, and monitoring the fall, the posture, the walking speed, the positions, and other biomechanical parameters of the target objects in the region of interest as disclosed in the detailed description of FIGS. 1A-1B, and for assessing health of the target objects. The BPDS 501 implements specific computer programs for determining the fall, the posture, the walking speed, the positions, and other biomechanical parameters of the target objects and for assessing health of the target objects.

Figure 7A:
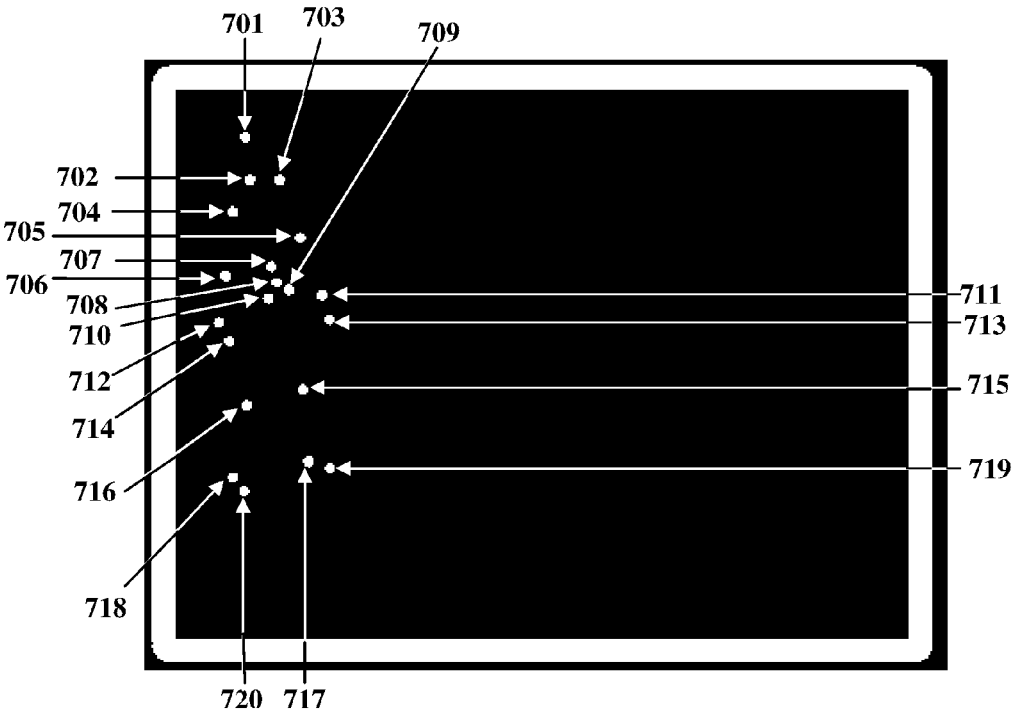
FIGS. 7A-7V exemplarily illustrate monitoring of a target object performed by the biomechanical parameter determination system.
Figure 7B:
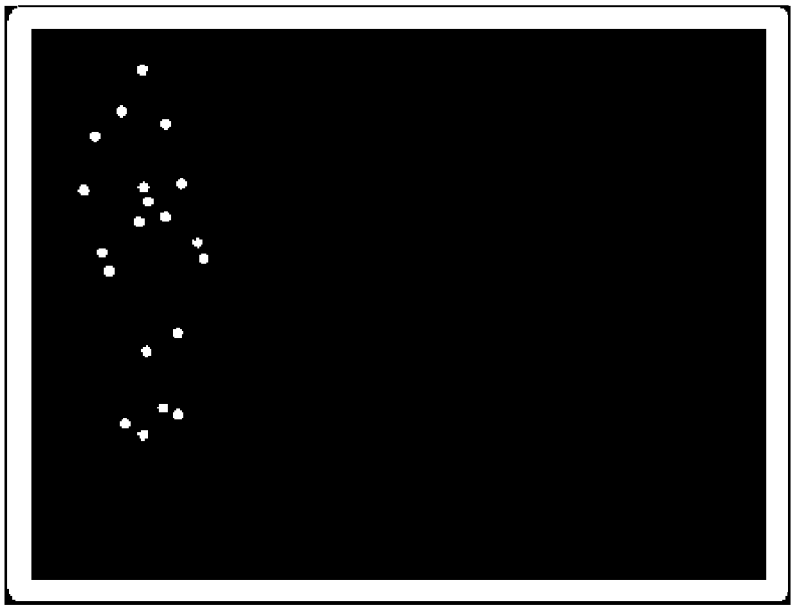
Figure 7C:
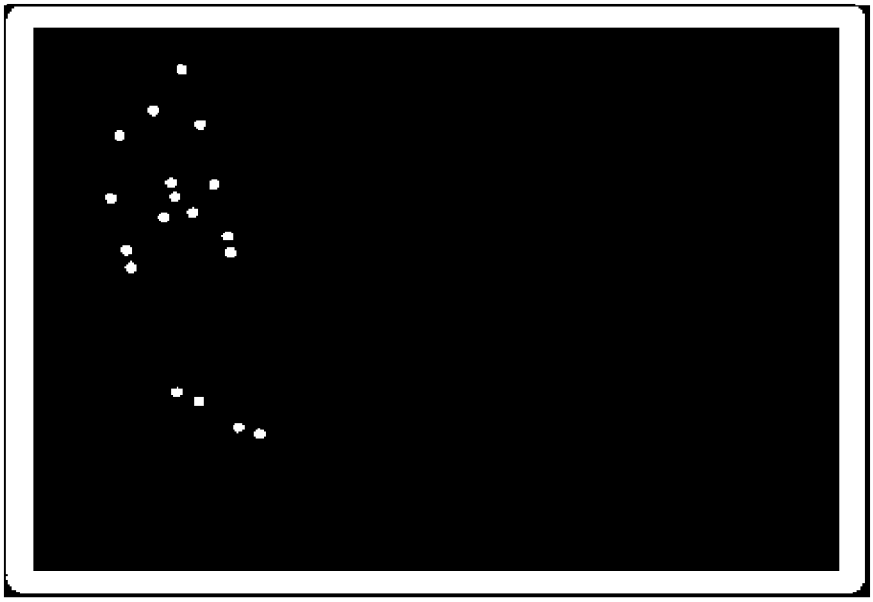
Figure 7D:
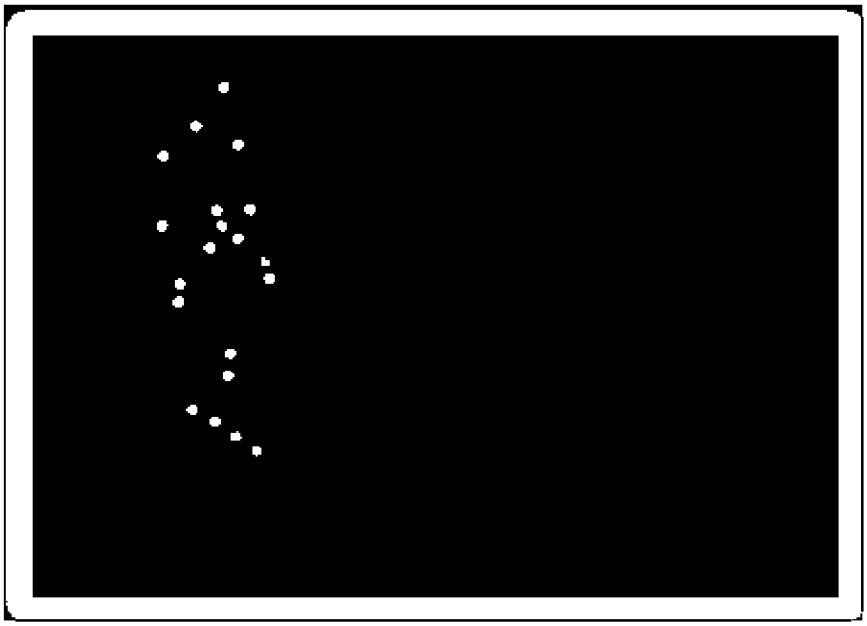
Figure 7E:
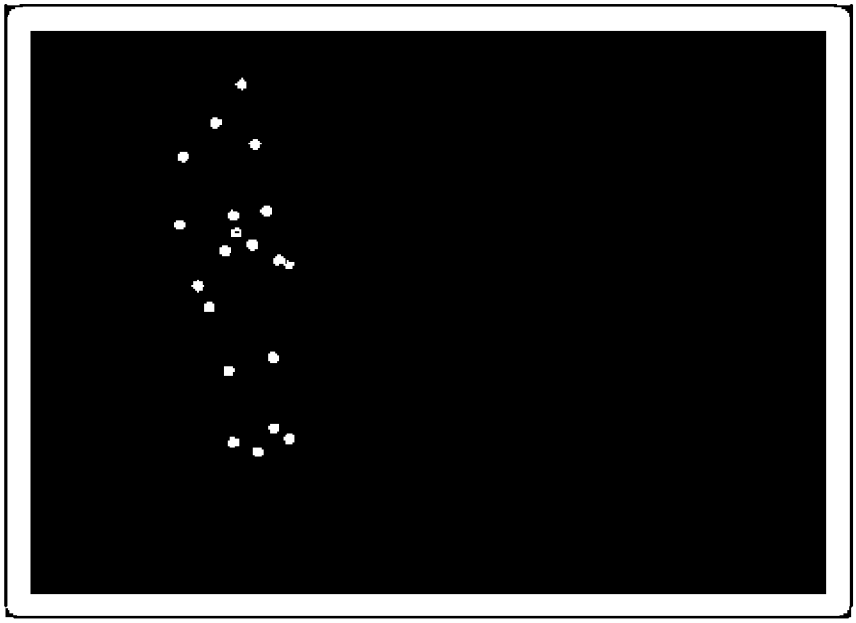
Figure 7F:
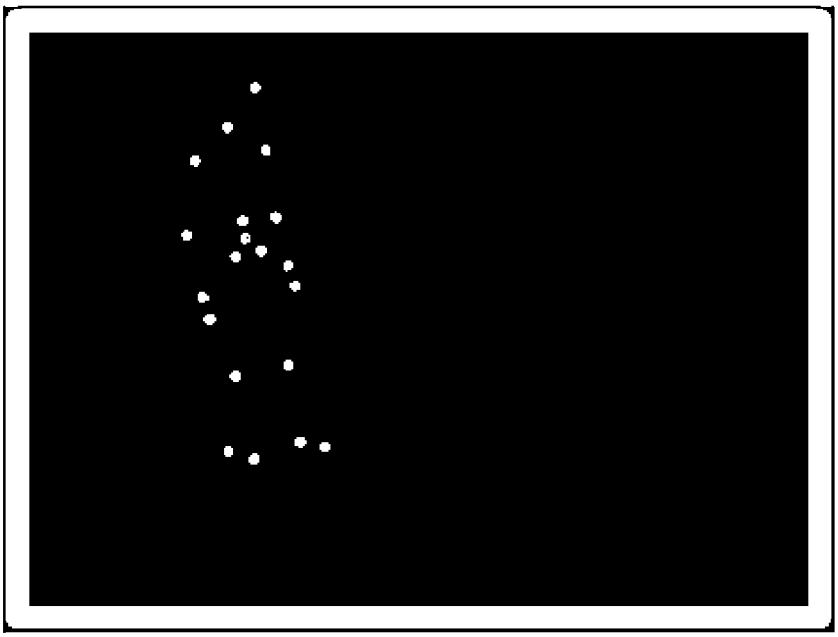
Figure 7G:
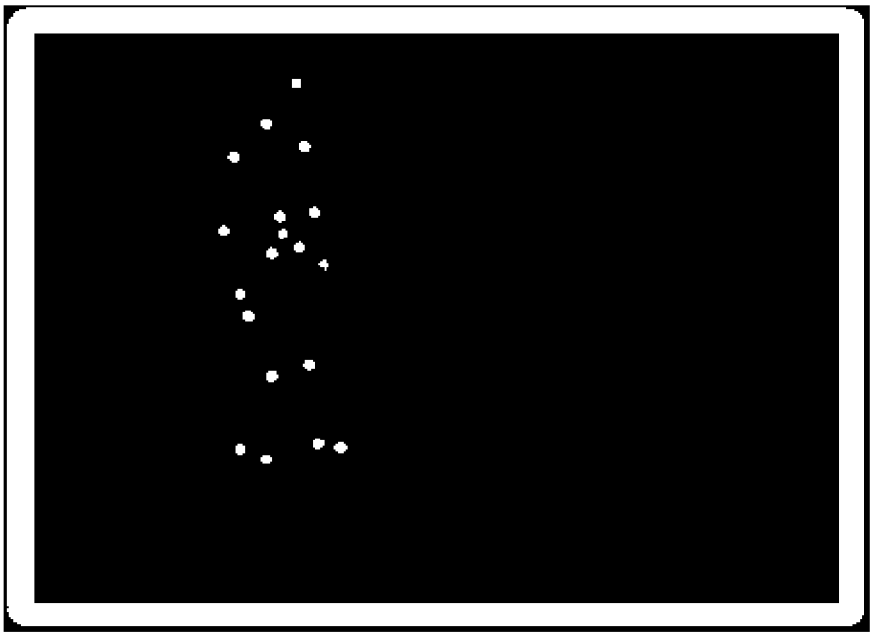
Figure 7H:
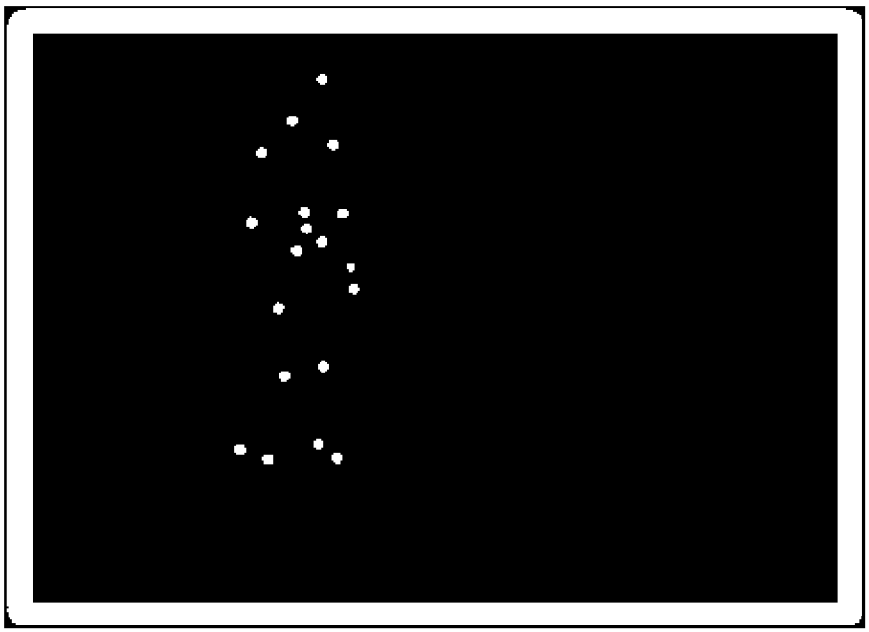
Figure 7I:
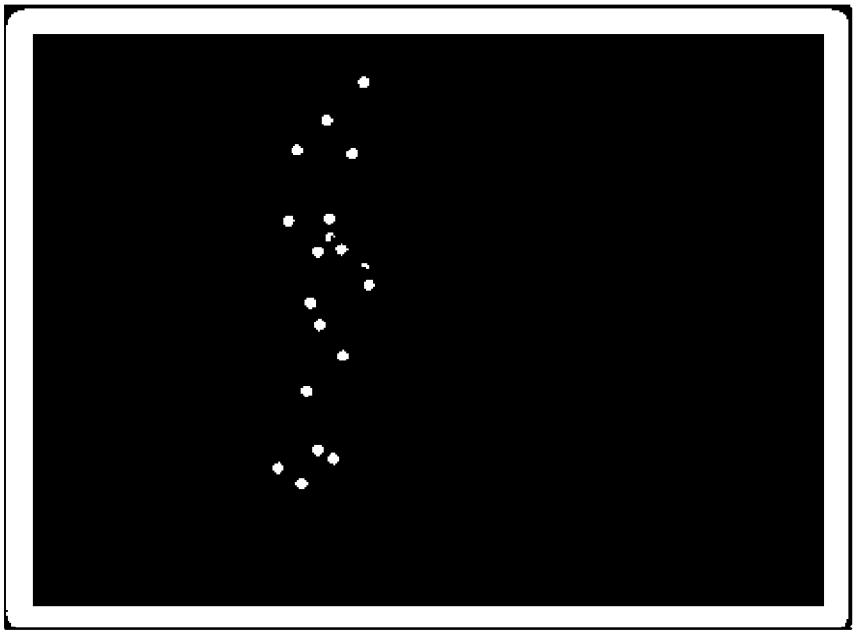
Figure 7J:
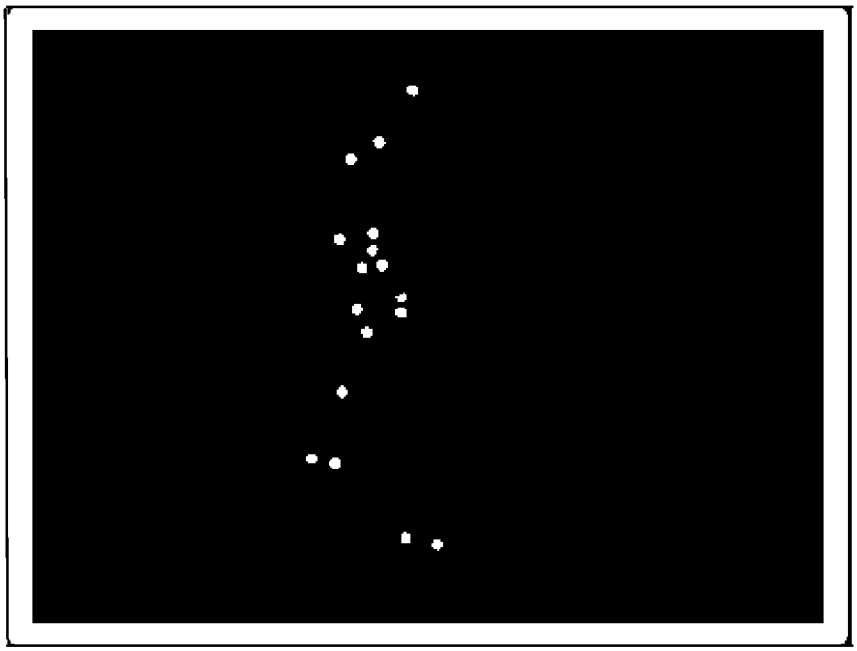
Figure 7K:
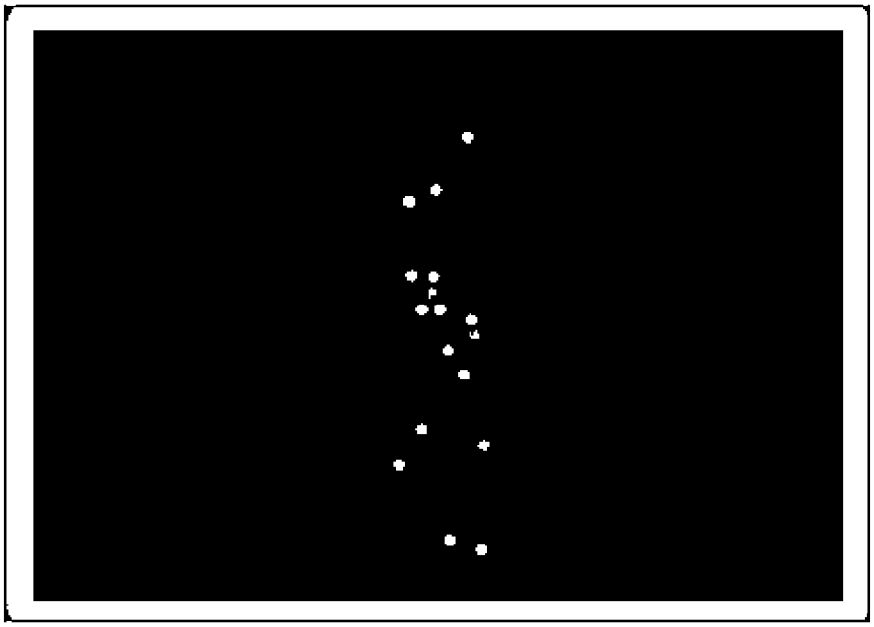
Figure 7L:
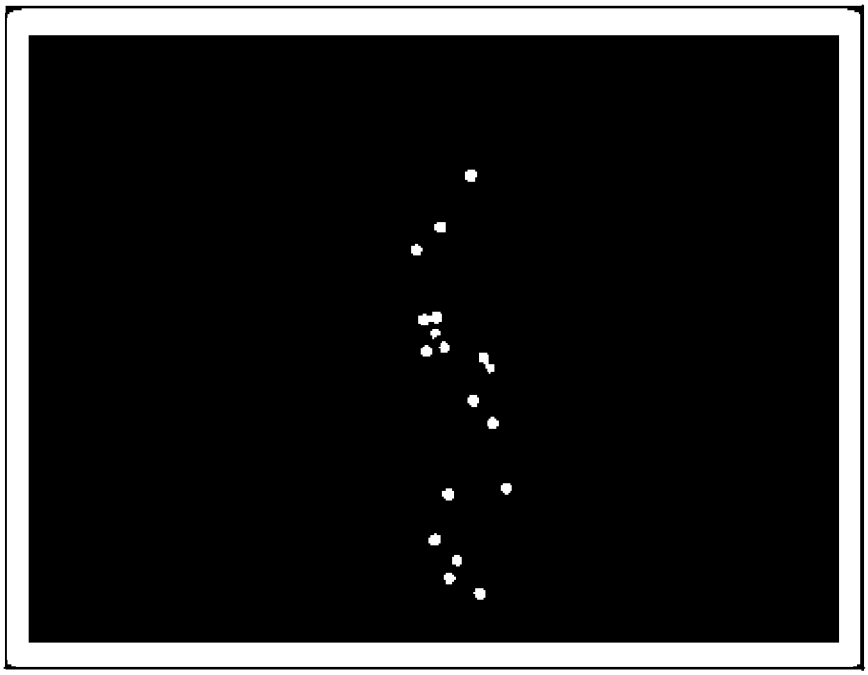
Figure 7M:
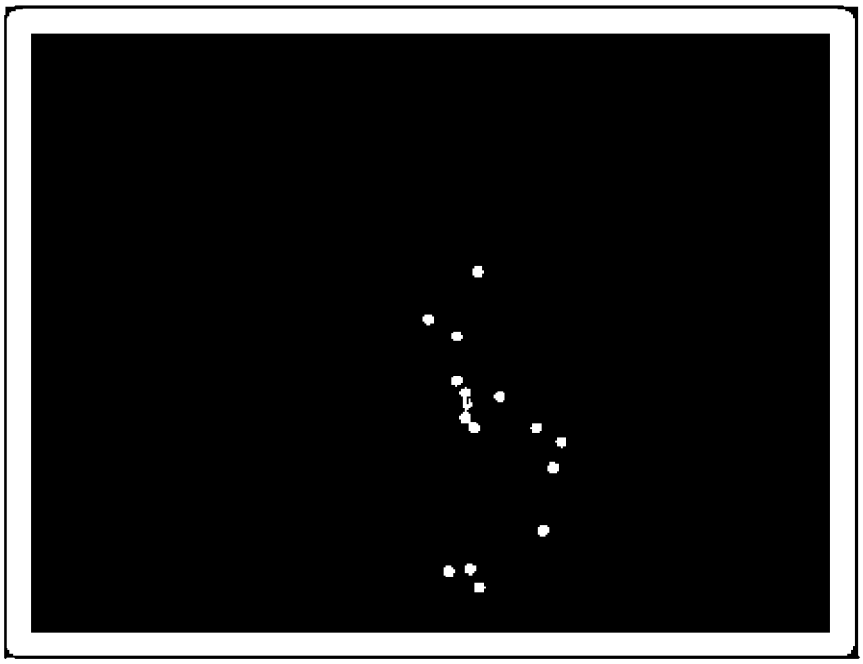
Figure 7N:
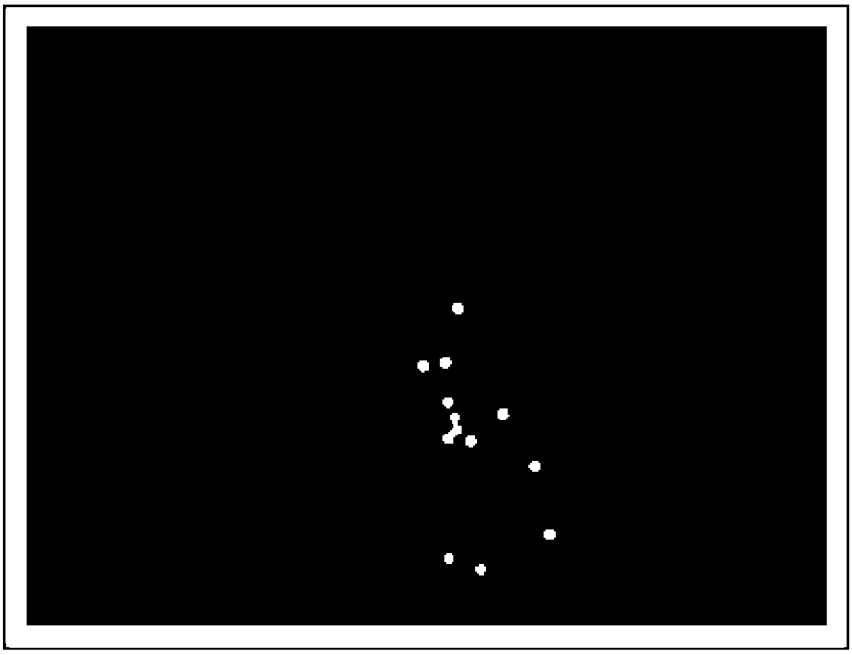
Figure 7O:
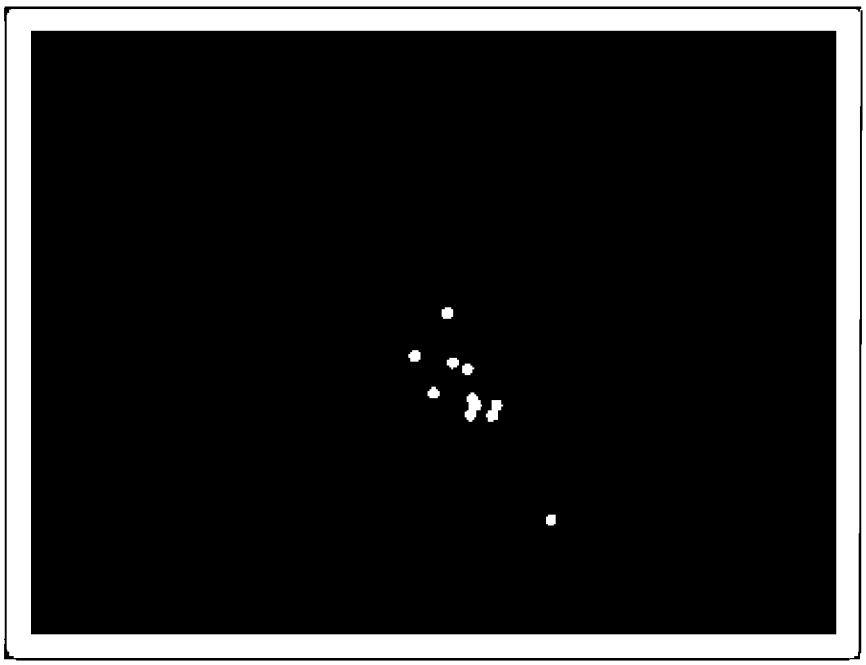
Figure 7P:
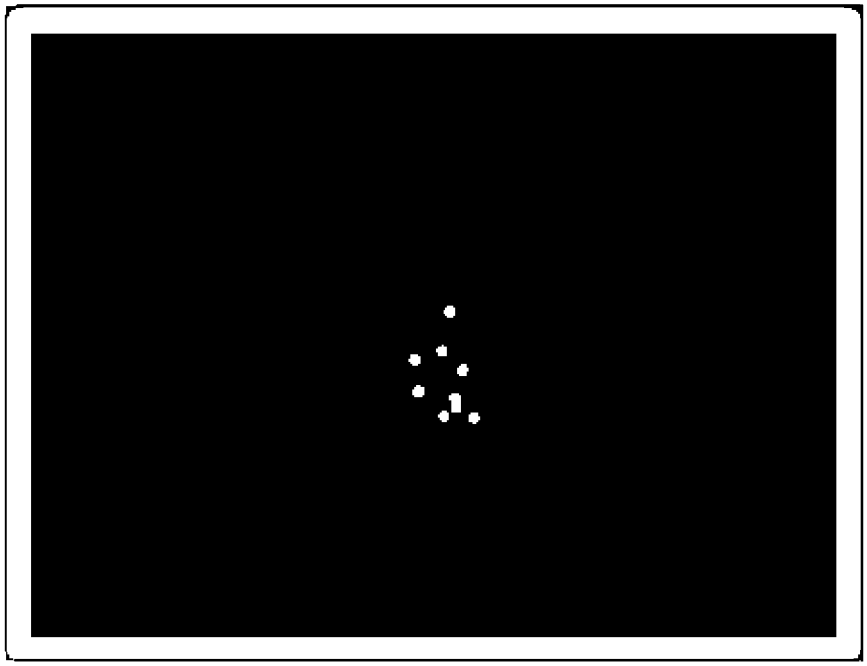
Figure 7Q:
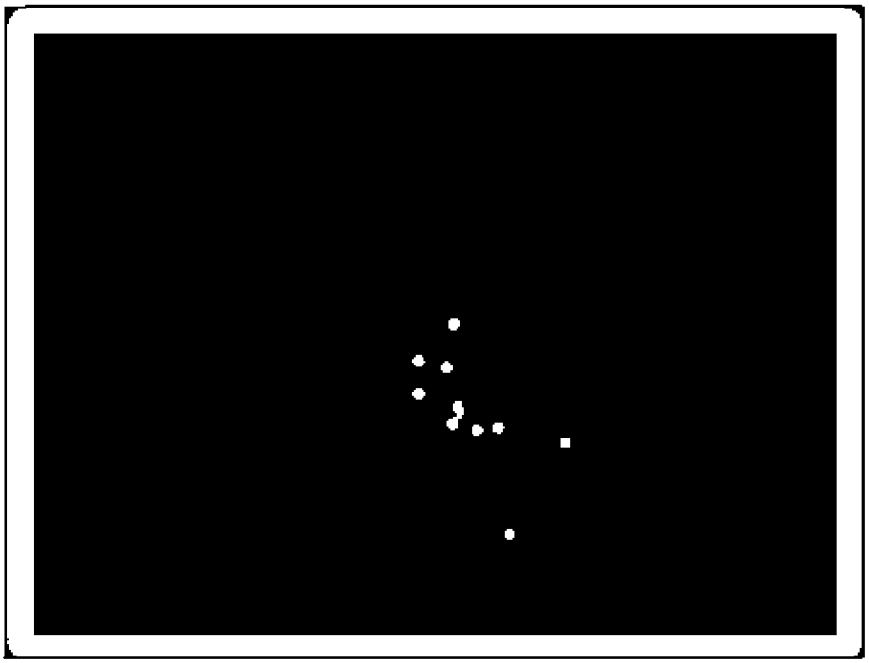
Figure 7R:
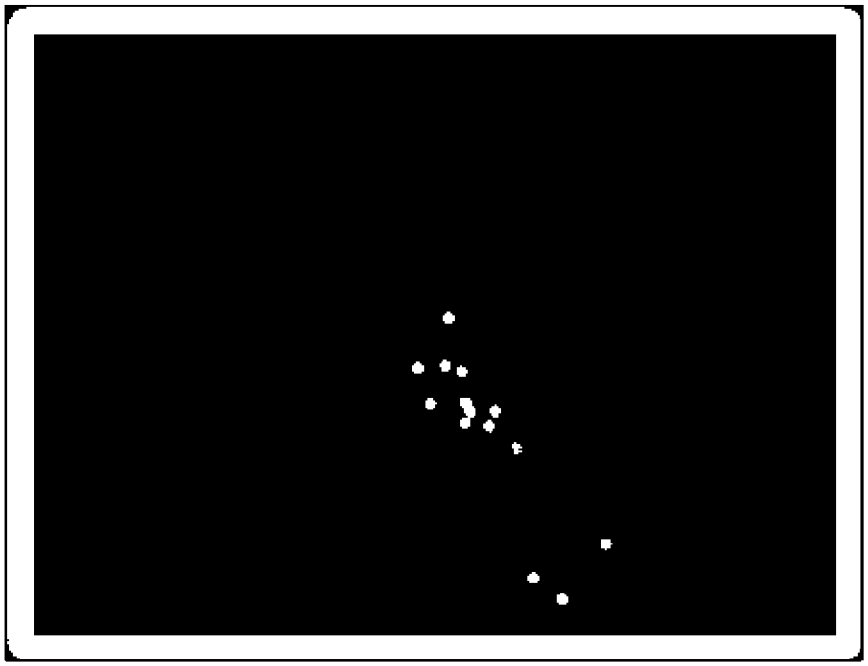
Figure 7S:
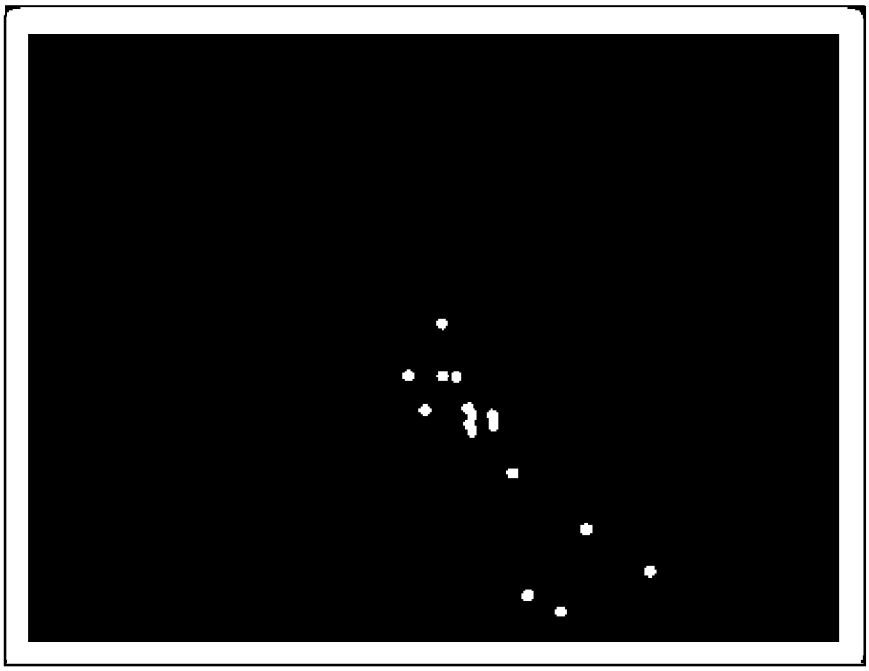
Figure 7T:
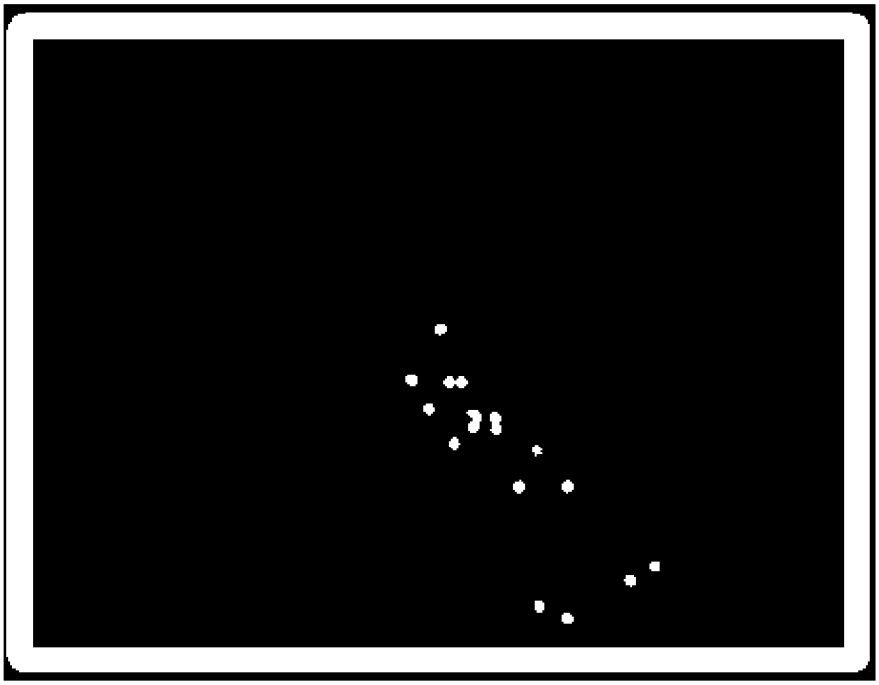
Figure 7U:
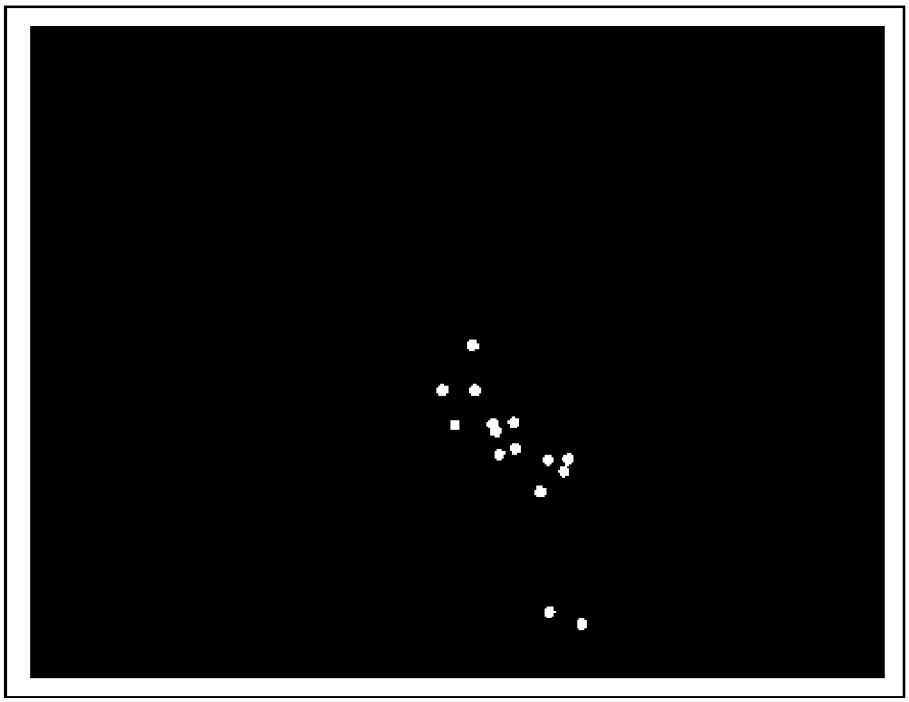
Figure 7V:
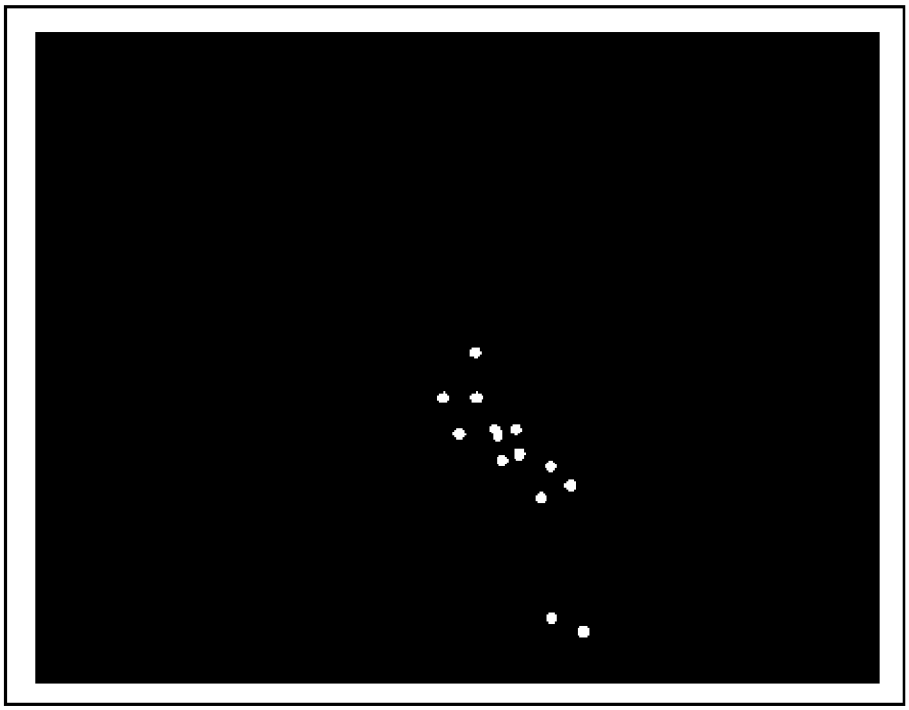

FIGS. 7A-7V exemplarily illustrate monitoring of a target object performed by the biomechanical parameter determination system (BPDS) 501 exemplarily illustrated in FIG. 5. Consider an example of a target object such as a human in a dark room being monitored by the BPDS 501. When the human enters into a region of operation of the BPDS 501, the first sensors 201, for example, pyroelectric infrared (PIR) sensors dynamically capture temperature and motion of the human in the region of operation, and the second sensors 202, for example, ultrasound sensors, audio sensors, etc., dynamically capture sound data of the human, and amplitude and distance of the human from the second sensors 202. The BPDS 501 utilizes the data from the first sensors 201 and the second sensors 202 to determine the biomechanical parameters, for example, a fall, posture, walking speed, positions, acceleration, etc., of the human as disclosed in the detailed description of FIGS. 1A-1B, and constantly monitors the human in the dark room.

As exemplarily illustrated in the FIGS. 7A-7L, the biomechanical parameter determination system (BPDS) 501 performs a filtering operation to identify and map various moving body parts, for example, head, neck, shoulders, arms, abdomen, knees, ankles, foot, etc., of the human in the dark room, for example, through skeletonization. The skeletonization of the moving human provides information of the body parts and the BPDS 501 determines the posture of the human using the relative locations of the body parts. The BPDS 501 continuously monitors the human moving in the dark room via the first sensors 201 and the second sensors 202. The BPDS 501 identifies and determines the points on the body parts of the human using the temperature data of the human in the dark room from the first sensors 201 with respect to a predetermined temperature threshold range. The points exemplarily illustrated in the FIGS. 7A-7V, represent the body parts of the moving human. The BPDS 501 uses the points to track the posture of the human. The BPDS 501 determines the position of the human using the motion data from the first sensors 201 and/or the second sensors 202. As the human moves in the dark room, the points that are associated with the human also move. The walking movement of the human along with the associated points is exemplarily illustrated in the FIGS. 7A-7L. The BPDS 501 determines the walking speed during the walking movement of the human.

When there is a change in the posture, the points representing the body parts such as the head 701, the shoulders 702, 703, and 704, elbows 705 and 706, the spine 707, hip 708, 709, and 710, wrists 711 and 712, hands 713 and 714, knees 715 and 716, ankles 717 and 718, foot 719 and 720 of the human exemplarily illustrated in FIG. 7A, indicate a change in the posture of the human. For example, when the human falls, the position of the points representing the body parts of the human indicate the fall as exemplarily illustrated in FIGS. 7M-7V. The points representing the head 701, shoulder center 702, left shoulder 703, right shoulder 704, left elbow 705, right elbow 706, the spine 707, hip center 708, left hip 709, right hip 710, left wrist 711, right wrist 712, left hand 713, right hand 714, left knee 715, right knee 716, left ankle 717, right ankle 718, left foot 719, and right foot 720 of the human appear to be substantially closer to each other when the human lies on the ground after the fall as exemplarily illustrated in FIGS. 70-7S, as compared to a normal stature of the human while walking as exemplarily illustrated in the FIGS. 7A-7L. After the fall of the human, the points representing the head 701, the shoulder center 702, the left shoulder 703, the right shoulder 704, the left elbow 705, the right elbow 706, the spine 707, the hip center 708, the left hip 709, the right hip 710, the left wrist 711, the right wrist 712, the left hand 713, the right hand 714, the left knee 715, the right knee 716, the left ankle 717, the right ankle 718, the left foot 719, and the right foot 720 of the human appear to be substantially closer to the ground and positioned horizontal to the ground as exemplarily illustrated in FIGS. 70-7S, when compared to the human walking, where the points of the human appear to be vertical to the ground as exemplarily illustrated in the FIGS. 7A-7L.

If the posture of the human resembles a fall posture stored in the health template repository 406 exemplarily illustrated in FIGS. 4-5, and the walking speed slows or stalls, the biomechanical parameter determination system (BPDS) 501 determines a fall and prompts a question, for example, "Do you need help" to the human and dynamically listens through the audio sensors for sound data, for example, a response from the human on the ground. The posture of the fall is exemplarily illustrated in the FIGS. 7M-7V, where the points of the human in FIGS. 7M-7N exemplarily illustrate the beginning of the fall, and the points in FIGS. 70-7V exemplarily illustrate the fallen human with minimal movement of the body parts. If the target objects do not provide sound data, for example, respond within a predetermined amount of time, for example, 5 seconds, the BPDS 501 alerts respondents, for example, via a message regarding the occurrence of the fall and the severity of the fall of the human.

It will be readily apparent in different embodiments that the various methods, algorithms, and computer programs disclosed herein are implemented on non-transitory computer readable storage media appropriately programmed for computing devices. The non-transitory computer readable storage media participates in providing data, for example, instructions that are read by a computer, a processor or a similar device. In different embodiments, the "non-transitory computer readable storage media" further refers to a single medium or multiple media, for example, a centralized database, a distributed database, and/or associated caches and servers that store one or more sets of instructions that are read by a computer, a processor or a similar device. The "non-transitory computer readable storage media" further refers to any medium capable of storing or encoding a set of instructions for execution by a computer, a processor or a similar device and that causes a computer, a processor or a similar device to perform any one or more of the methods disclosed herein. Common forms of non-transitory computer readable storage media comprise, for example, a floppy disk, a flexible disk, a hard disk, magnetic tape, a laser disc, a Blu-ray Disc® of the Blu-ray Disc Association, any magnetic medium, a compact disc-read only memory (CD- ROM), a digital versatile disc (DVD), any optical medium, a flash memory card, punch cards, paper tape, any other physical medium with patterns of holes, a random access memory (RAM), a programmable read only memory (PROM), an erasable programmable read only memory (EPROM), an electrically erasable programmable read only memory (EEPROM), a flash memory, any other memory chip or cartridge, or any other medium from which a computer can read.

In an embodiment, the computer programs that implement the methods and algorithms disclosed herein are stored and transmitted using a variety of media, for example, the computer readable media in a number of manners. In an embodiment, hard-wired circuitry or custom hardware is used in place of, or in combination with, software instructions for implementing the processes of various embodiments. Therefore, the embodiments are not limited to any specific combination of hardware and software. The computer program codes comprising computer executable instructions can be implemented in any programming language. Examples of programming languages that can be used in the method disclosed herein are C, C++, C#, Java®, JavaScript®, Fortran, Ruby, Perl®, Python®, Visual Basic®, hypertext preprocessor (PHP), Microsoft®.NET, Objective-C®, etc. Other object-oriented, functional, scripting, and/or logical programming languages can also be used. In an embodiment, the computer program codes or software programs are stored on or in one or more mediums as object code. In another embodiment, various aspects of the method and the system 500 exemplarily illustrated in FIGS. 5-6, disclosed herein are implemented in a non-programmed environment comprising documents created, for example, in a hypertext markup language (HTML), an extensible markup language (XML), or other format that render aspects of the graphical user interface (GUI) 504*a* exemplarily illustrated in FIG. 5, or perform other functions, when viewed in a visual area or a window of a browser program. In another embodiment, various aspects of the method and the system 500 disclosed herein are implemented as programmed elements, or non-programmed elements, or any suitable combination thereof.

Where databases are described such as the databases 502*o* exemplarily illustrated in FIG. 5, it will be understood by one of ordinary skill in the art that (i) alternative database structures to those described may be employed, and (ii) other memory structures besides databases may be employed. Any illustrations or descriptions of any sample databases disclosed herein are illustrative arrangements for stored representations of information. In an embodiment, any number of other arrangements are employed besides those suggested by tables illustrated in the drawings or elsewhere. Similarly, any illustrated entries of the databases represent exemplary information only; one of ordinary skill in the art will understand that the number and content of the entries can be different from those disclosed herein. In another embodiment, despite any depiction of the databases as tables, other formats including relational databases, object-based models, and/or distributed databases are used to store and manipulate the data types disclosed herein. Object methods or behaviors of a database can be used to implement various processes such as those disclosed herein. In another embodiment, the databases are, in a known manner, stored locally or remotely from a device that accesses data in such a database. In embodiments where there are multiple databases in the system 500, the databases are integrated to communicate with each other for enabling simultaneous updates of data linked across the databases, when there are any updates to the data in one of the databases.

The method and the system 500 disclosed herein can be configured to work in a network environment comprising one or more computers that are in communication with one or more devices via the network 513 exemplarily illustrated in FIGS. 5-6. In an embodiment, the computers communicate with the devices directly or indirectly, via a wired medium or a wireless medium such as the Internet, a local area network (LAN), a wide area network (WAN) or the Ethernet, a token ring, or via any appropriate communications mediums or combination of communications mediums. Each of the devices comprises processors, examples of which are disclosed above, that are adapted to communicate with the computers. In an embodiment, each of the computers is equipped with a network communication device, for example, a network interface card, a modem, or other network connection device suitable for connecting to the network 513. Each of the computers and the devices executes an operating system, examples of which are disclosed above. While the operating system may differ depending on the type of computer, the operating system provides the appropriate communications protocols to establish communication links with the network 513. Any number and type of machines may be in communication with the computers.

The method and the system 500 disclosed herein are not limited to a particular computer system platform, processor, operating system, or network. In an embodiment, one or more aspects of the method and the system 500 disclosed herein are distributed among one or more computer systems, for example, servers configured to provide one or more services to one or more client computers, or to perform a complete task in a distributed system. For example, one or more aspects of the method and the system 500 disclosed herein are performed on a client-server system that comprises components distributed among one or more server systems that perform multiple functions according to various embodiments. These components comprise, for example, executable, intermediate, or interpreted code, which communicate over the network 513 using a communication protocol. The method and the system 500 disclosed herein are not limited to be executable on any particular system or group of systems, and are not limited to any particular distributed architecture, network, or communication protocol.

The foregoing examples have been provided merely for the purpose of explanation and are in no way to be construed as limiting of the method and the system 500 disclosed herein. While the method and the system 500 have been described with reference to various embodiments, it is understood that the words, which have been used herein, are words of description and illustration, rather than words of limitation. Further, although the method and the system 500 have been described herein with reference to particular means, materials, and embodiments, the method and the system 500 are not intended to be limited to the particulars disclosed herein; rather, the method and the system 500 extend to all functionally equivalent structures, methods and uses, such as are within the scope of the appended claims. Those skilled in the art, having the benefit of the teachings of this specification, may effect numerous modifications thereto and changes may be made without departing from the scope and spirit of the method and the system 500 disclosed herein in their aspects.

We claim:

1. A method for determining biomechanical parameters of one or more target objects in a region, said method employing a biomechanical parameter determination system comprising at least one processor configured to execute computer program instructions for performing said method comprising:

dynamically receiving first data comprising temperature data and motion data of said one or more target objects in said region from one or more first sensors positioned in one or more spatial directions in said region, by said biomechanical parameter determination system over a network;

dynamically receiving second data comprising optical images, sound data, amplitude, and distance of said one or more target objects in said region from one or more second sensors positioned in one or more spatial directions in said region, by said biomechanical parameter determination system over said network;

filtering said dynamically received first data and said dynamically received second data of said one or more target objects by said biomechanical parameter determination system;

identifying one or more target objects in said region by said biomechanical parameter determination system using said temperature data and said motion data of said one or more target objects in said region extracted from said filtered first data; and determining one or more of a plurality of said biomechanical parameters associated with each of said identified one or more target objects in said region by said biomechanical parameter determination system using one of said filtered first data, said filtered second data, and a combination thereof, for one or more of emergency alerting and health assessment;

wherein said determination of said one or more of said biomechanical parameters associated with said each of said identified one or more target objects in said region comprises:

determining positions of said identified one or more target objects in said region and tracking said determined positions of said identified one or more target objects as a function of time to generate position-time values by said biomechanical parameter determination system;

determining speed of motion of said each of said identified one or more target objects extracted from said one of said filtered first data, said filtered second data, and said combination thereof, using said generated position-time values by said biomechanical parameter determination system;

determining acceleration of said each of said identified one or more target objects using one of said generated position-time values and said determined speed of said motion of said each of said identified one or more target objects by said biomechanical parameter determination system;

determining walking speed of said each of said identified one or more target objects using said determined speed of said motion of said each of said identified one or more target objects based on walking criteria by said biomechanical parameter determination system; and determining fall and posture of said each of said identified one or more target objects by said biomechanical parameter determination system using one or more of said determined speed of said motion of said each of said identified one or more target objects, said determined acceleration of said each of said identified one or more target objects, and change in said determined positions of said identified one or more target objects followed by a predetermined time period of inactivity by said each of said identified one or more target objects, to alert a respondent.

2. The method of claim 1, wherein said biomechanical parameters comprise positions of said identified one or more target objects in said region, acceleration of said each of said identified one or more target objects, walking speed of said each of said identified one or more target objects, and fall and posture of said each of said identified one or more target objects.

3. The method of claim 1, wherein said determination of said speed of said motion of said each of said identified one or more target objects is performed by curve-fitting said generated position-time values by said biomechanical parameter determination system.

4. The method of claim 1, wherein said determination of said acceleration of said each of said identified one or more target objects is performed by curve-fitting of one of velocity-time values and location-time values by said biomechanical parameter determination system.

5. The method of claim 1, wherein said walking criteria comprise a falling condition, a running condition, a normal walking condition, and an intent based walking condition.

6. The method of claim 1, further comprising recording a time of occurrence of said determined fall of said each of said identified one or more target objects, a location of said occurrence of said determined fall, a speed of said determined fall, an acceleration associated with said determined fall, and a pattern of said determined fall by said biomechanical parameter determination system in one or more databases.

7. The method of claim 1, further comprising determining a severity level of said determined fall of said each of said identified one or more target objects by comparing a pattern of said determined fall with predetermined template patterns of falls stored in one or more databases by said biomechanical parameter determination system.

8. The method of claim 1, wherein said identification of said one or more target objects in said region is performed by said biomechanical parameter determination system by estimating one or more of temperature and motion of each of said one or more target objects in said region based on a predetermined threshold range.

9. The method of claim 1, further comprising:

splitting said sound data extracted from said filtered second data into sound snippets by said biomechanical parameter determination system; and analyzing said sound snippets one of independently and in conjunction with one of said first data, another of said second data, and a combination thereof, along with preconfigured sound templates by said biomechanical parameter determination system for said determination of said one or more of said biomechanical parameters associated with said each of said identified one or more target objects in said region.

10. The method of claim 1, further comprising rendering question prompts to said one or more target objects in said region, interpreting one of a response and a non-response to said question prompts to confirm a fall of said each of said identified one or more target objects in said region, and alerting one or more respondents based on said interpretation via said network, by said biomechanical parameter determination system.

11. The method of claim 1, further comprising storing said dynamically received first data and said dynamically received second data of said one or more target objects by said biomechanical parameter determination system in one or more databases.

12. The method of claim 1, further comprising assessing health of said each of said identified one or more target objects by said biomechanical parameter determination system in communication with a health template repository using said determined one or more of said biomechanical parameters comprising a walking speed, a fall, and a posture associated with said each of said identified one or more target objects in said region.

13. The method of claim 12, wherein said assessment of said health of said each of said identified one or more target objects by said biomechanical parameter determination system comprises determining a fall risk of said each of said identified one or more target objects by performing a time analysis of one of said walking speed, said posture, and a combination thereof, of said each of said identified one or more target objects.

14. The method of claim 1, further comprising generating alerts that indicate one or more of an occurrence of a fall, a health status, and a fall risk using said determined one or more of said biomechanical parameters by said biomechanical parameter determination system and transmitting said generated alerts to one or more respondents by said biomechanical parameter determination system via said network.

15. The method of claim 1, wherein said one or more first sensors comprise one or more of one-dimensional pyroelectric infrared sensors and two-dimensional pyroelectric infrared sensors.

16. The method of claim 1, wherein said one or more second sensors comprise one or more of one-dimensional optical sensors, two-dimensional optical sensors, one-dimensional ultrasound sensors, two-dimensional ultrasound sensors, and audio sensors.

17. The method of claim 1, wherein said filtering of said dynamically received first data and said dynamically received second data of said one or more target objects comprises one of:

spatially filtering said dynamically received first data and said dynamically received second data of said one or more target objects using a spatial filter; and temporally filtering said dynamically received first data and said dynamically received second data of said one or more target objects using a temporal filter.

18. The method of claim 17, wherein said spatial filter is one of a spatial smoothing filter, a threshold based on one of intensity, temperature, and motion, and a frequency domain filter.

19. The method of claim 17, wherein said temporal filter is one of a temporal smoothing filter, a threshold based on one of an intensity and a temperature value, and a frequency domain filter.

20. The method of claim 17, further comprising performing morphological image processing on said dynamically received first data and said dynamically received second data of said one or more target objects by a morphological image processing unit in operable communication with one of said spatial filter and said temporal filter.

21. A system for determining biomechanical parameters of one or more target objects in a region, said system comprising:

a plurality of sensors positioned in one or more spatial directions in said region, said sensors comprising:

one or more first sensors for detecting temperature and motion of said one or more target objects in said region; and one or more second sensors for capturing optical images, detecting sound, and determining amplitude and distance of said one or more target objects in said region; and a biomechanical parameter determination system operably coupled to said sensors, said biomechanical parameter determination system comprising:

a non-transitory computer readable storage medium configured to store computer program instructions defined by modules of said biomechanical parameter determination system; and at least one processor communicatively coupled to said non-transitory computer readable storage medium and operably coupled to said sensors, said at least one processor configured to execute said computer program instructions defined by said modules of said biomechanical parameter determination system, said modules comprising:

a data reception module configured to dynamically receive first data comprising said temperature data and said motion data of said one or more target objects in said region from said one or more first sensors over a network;

said data reception module further configured to dynamically receive second data comprising said optical images, said sound data, said amplitude, and said distance of said one or more target objects in said region from said one or more second sensors over said network;

a data filter module configured to filter said dynamically received first data and said dynamically received second data of said one or more target objects;

an object identification module configured to identify one or more target objects in said region using said said temperature data and said motion data of said one or more target objects in said region extracted from said filtered first data; and a biomechanical parameter determination module configured to determine one or more of a plurality of said biomechanical parameters associated with each of said identified one or more target objects in said region using one of said filtered first data, said filtered second data, and a combination thereof, for one or more of emergency alerting and health assessment;

wherein said biomechanical parameter determination module comprises:

a position determination module configured to determine positions of said identified one or more target objects in said region and track said determined positions of said identified one or more target objects as a function of time to generate position-time values;

a speed determination module configured to determine speed of said motion of said each of said identified one or more target objects extracted from said one of said filtered first data, said filtered second data, and said combination thereof, using said generated position-time values;

an acceleration determination module configured to determine acceleration of said each of said identified one or more target objects using one of said generated position-time values and said determined speed of said motion of said each of said identified one or more target objects;

a walking speed determination module configured to determine walking speed of said each of said identified one or more target objects using said determined speed of said motion of said each of said identified one or more target objects based on walking criteria, said walking criteria comprising a falling condition, a running condition, a normal walking condition, and an intent based walking condition; and a fall and posture determination module configured to determine fall and posture of said each of said identified one or more target objects using one or more of said determined speed of said motion of said each of said identified one or more target objects, said determined acceleration of said each of said identified one or more target objects, and change in said determined positions of said identified one or more target objects followed by a predetermined time period of inactivity by said each of said identified one or more target objects, to alert a respondent.

22. The system of claim 21, wherein said biomechanical parameters comprise positions of said identified one or more target objects in said region, acceleration of said each of said identified one or more target objects, walking speed of said each of said identified one or more target objects, and fall and posture of said each of said identified one or more target objects.

23. The system of claim 21, wherein said biomechanical parameter determination module comprises:

a sound processing module configured to split said sound data extracted from said filtered second data into sound snippets; and an analytics engine configured to analyze said sound snippets one of independently and in conjunction with one of said first data, another of said second data, and a combination thereof, along with preconfigured sound templates for said determination of said one or more of said biomechanical parameters associated with said each of said identified one or more target objects in said region.

24. The system of claim 23, wherein said sound processing module is further configured to render question prompts to said one or more target objects in said region and interpret one of a response and a non-response to said question prompts to confirm a fall of said each of said identified one or more target objects in said region, and wherein said alerting module is further configured to alert one or more respondents based on said interpretation via said network.

25. The system of claim 21, wherein said modules of said biomechanical parameter determination system further comprise a storage module configured to store said dynamically received first data and said dynamically received second data of said one or more target objects in one or more databases, and wherein said storage module is further configured to record a time of occurrence of a fall of said each of said identified one or more target objects, a location of said occurrence of said fall, a speed of said fall, an acceleration associated with said fall, and a pattern of said fall in said one or more databases.

26. The system of claim 21, wherein said modules of said biomechanical parameter determination system further comprise an analytics engine configured to assess health of said each of said identified one or more target objects in communication with a health template repository using said determined one or more of said biomechanical parameters comprising a walking speed, a fall, and a posture associated with said each of said identified one or more target objects in said region.

27. The system of claim 26, wherein said analytics engine is further configured to determine a fall risk of said each of said identified one or more target objects by performing a time analysis of one of said walking speed, said posture, and a combination thereof, of said each of said identified one or more target objects.

28. The system of claim 21, wherein said modules of said biomechanical parameter determination system further comprise an alerting module configured to generate alerts that indicate one or more of an occurrence of a fall, a health status, and a fall risk using said determined one or more of said biomechanical parameters, and wherein said alerting module is further configured to transmit said generated alerts to one or more respondents via said network.

29. The system of claim 21, wherein said one or more first sensors comprise one or more of one-dimensional pyroelectric infrared sensors and two-dimensional pyroelectric infrared sensors.

30. The system of claim 21, wherein said one or more second sensors comprise one or more of one-dimensional optical sensors, two-dimensional optical sensors, one-dimensional ultrasound sensors, two-dimensional ultrasound sensors, and audio sensors.

31. The system of claim 21, wherein said data filter module is configured to filter said dynamically received first data and said dynamically received second data of said one or more target objects by one of spatially filtering said dynamically received first data and said dynamically received second data of said one or more target objects using a spatial filter and temporally filtering said dynamically received first data and said dynamically received second data of said one or more target objects using a temporal filter.

32. The system of claim 31, wherein said modules of said biomechanical parameter determination system further comprise a morphological image processing unit operably coupled to one of said spatial filter and said temporal filter and configured to perform morphological image processing on said dynamically received first data and said dynamically received second data of said one or more target objects.

33. A non-transitory computer readable storage medium having embodied thereon, computer program codes comprising instructions executable by at least one processor for determining biomechanical parameters of one or more target objects in a region, said computer program codes comprising:

a first computer program code for dynamically receiving first data comprising one or more of temperature data and motion data of said one or more target objects in said region from one or more first sensors positioned in one or more spatial directions in said region over a network;

a second computer program code for dynamically receiving second data comprising one or more of optical images, sound data, amplitude, and distance of said one or more target objects in said region from one or more second sensors positioned in one or more spatial directions in said region over said network;

a third computer program code for filtering said dynamically received first data and said dynamically received second data of said one or more target objects;

a fourth computer program code for identifying one or more target objects in said region using said one or more of said temperature data and said motion data of said one or more target objects in said region extracted from said filtered first data; and a fifth computer program code for determining one or more of a plurality of said biomechanical parameters associated with each of said identified one or more target objects in said region by said biomechanical parameter determination system using one of said filtered first data, said filtered second data, and a combination thereof, for one or more of emergency alerting and health assessment;

wherein said fifth computer program code further comprises:

a sixth computer program code for determining positions of said identified one or more target objects in said region and tracking said determined positions of said identified one or more target objects as a function of time to generate position-time values;

a seventh computer program code for determining speed of motion of said each of said identified one or more target objects extracted from said one of said filtered first data, said filtered second data, and said combination thereof, using said generated position-time values;

an eighth computer program code for determining acceleration of said each of said identified one or more target objects using one of said generated position-time values and said determined speed of said motion of said each of said identified one or more target objects;

a ninth computer program code for determining walking speed of said each of said identified one or more target objects using said determined speed of said motion of said each of said identified one or more target objects based on walking criteria, said walking criteria comprising a falling condition, a running condition, a normal walking condition, and an intent based walking condition; and a tenth computer program code for determining fall and posture of said each of said identified one or more target objects using one or more of said determined speed of said motion of said each of said identified one or more target objects, said determined acceleration of said each of said identified one or more target objects, and change in said determined positions of said identified one or more target objects followed by a predetermined time period of inactivity by said each of said identified one or more target objects, to alert a respondent.

34. The non-transitory computer readable storage medium of claim 33, wherein said biomechanical parameters comprise positions of said identified one or more target objects in said region, acceleration of said each of said identified one or more target objects, walking speed of said each of said identified one or more target objects, and fall and posture of said each of said identified one or more target objects.

35. The non-transitory computer readable storage medium of claim 33, wherein said fifth computer program code comprises:

an eleventh computer program code for splitting said sound data extracted from said filtered second data into sound snippets; and a twelfth computer program code for analyzing said sound snippets one of independently and in conjunction with one of said first data, another of said second data, and a combination thereof, along with preconfigured sound templates for said determination of said one or more of said biomechanical parameters associated with said each of said identified one or more target objects in said region.

36. The non-transitory computer readable storage medium of claim 33, wherein said computer program codes further comprise:

a thirteenth computer program code for rendering question prompts to said one or more target objects in said region;

a fourteenth computer program code for interpreting one of a response and a non-response to said question prompts to confirm a fall of said each of said identified one or more target objects in said region; and a fifteenth computer program code for alerting one or more respondents based on said interpretation via said network.

37. The non-transitory computer readable storage medium of claim 33, wherein said computer program codes further comprise a sixteenth computer program code for assessing health of said each of said identified one or more target objects in communication with a health template repository using said determined one or more of said biomechanical parameters comprising a walking speed, a fall, and a posture associated with said each of said identified one or more target objects in said region.

38. The non-transitory computer readable storage medium of claim 37, wherein said sixteenth computer program code comprises a seventeenth computer program code for determining a fall risk of said each of said identified one or more target objects by performing a time analysis of one of said walking speed, said posture, and a combination thereof, of said each of said identified one or more target objects.

39. The non-transitory computer readable storage medium of claim 33, wherein said computer program codes further comprise an eighteenth computer program code for generating alerts that indicate one or more of an occurrence of a fall, a health status, and a fall risk using said determined one or more of said biomechanical parameters and transmitting said generated alerts to one or more respondents via said network.

* * * * *